US006497288B2

(12) United States Patent
George et al.

(10) Patent No.: US 6,497,288 B2
(45) Date of Patent: Dec. 24, 2002

(54) DEVIATED BOREHOLE DRILLING ASSEMBLY

(75) Inventors: Grant E. E. George, Calgary (CA); Stephen M. Begg, Edmonton (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/882,546

(22) Filed: Jun. 15, 2001

(65) Prior Publication Data

US 2002/0023757 A1 Feb. 28, 2002

Related U.S. Application Data

(63) Continuation of application No. 09/305,775, filed on Apr. 16, 1999, now Pat. No. 6,283,208, which is a continuation-in-part of application No. 08/923,945, filed on Sep. 5, 1997, now Pat. No. 6,012,516.

(30) Foreign Application Priority Data

Apr. 27, 1998 (CA) ..... 2236047
Aug. 18, 1998 (CA) ..... 2245342

(51) Int. Cl.[7] ..... E21B 23/00; E21B 23/03

(52) U.S. Cl. ..... 166/377; 166/50; 166/117.5; 166/378; 166/382

(58) Field of Search ..... 166/50, 117, 117.5, 166/117.6, 181, 313, 377, 378, 381, 382; 175/82

(56) References Cited

U.S. PATENT DOCUMENTS 2,132,061 A 10/1938 Walker
3,215,204 A 11/1965 Sims
3,842,914 A * 10/1974 Mott ..... 166/377
5,113,938 A 5/1992 Clayton
5,154,231 A * 10/1992 Bailey et al. ..... 166/117.6 X
5,335,737 A 8/1994 Baugh
5,361,833 A * 11/1994 Schock et al. ..... 166/117.6
5,398,754 A * 3/1995 Dinhoble ..... 166/117.6
5,474,133 A * 12/1995 Sieber ..... 166/377
5,535,822 A 7/1996 Schock et al.
5,678,634 A * 10/1997 Rehbock et al. ..... 166/377
5,718,291 A * 2/1998 Lorgen et al. ..... 166/377
5,775,428 A * 7/1998 Davis et al. ..... 166/117.6 X
5,947,198 A * 9/1999 McKee et al. ..... 166/377 X
6,019,173 A * 2/2000 Saurer et al. ..... 166/117.6 X
6,209,636 B1 4/2001 Roberts et al.
6,279,659 B1 8/2001 Brunet
6,315,054 B1 11/2001 Brunet

* cited by examiner

*Primary Examiner*—George Suchfield
(74) *Attorney, Agent, or Firm*—Trop, Pruner & Hu, P.C.; Jeffrey E. Griffin; Brigitte L. Jeffery

(57) ABSTRACT

A tool for running and retrieving a whipstock in a subterranean wellbore includes a tool body that has one end that is adapted to be connected to a pipe. The tool body includes a rail defined thereon that is adapted to selectively engage a slot defined on the whipstock. The pipe is in fluid communication with a bore defined in the tool body. The tool body includes a latch assembly for releasably connecting to the whipstock. The latch assembly is adapted to be moved when pressure is applied to the tool bore through the pipe thereby enabling the connection and disconnection of the latch assembly from the whipstock.

36 Claims, 26 Drawing Sheets

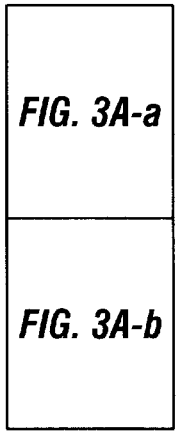
FIG. 3A
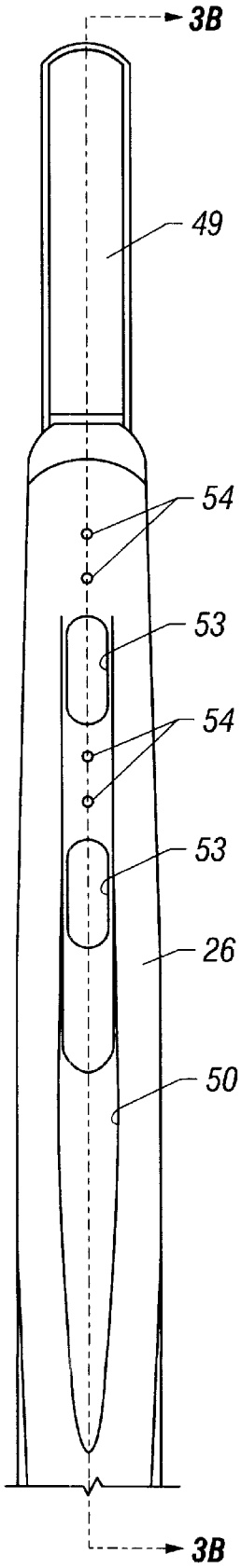
FIG. 3A-a
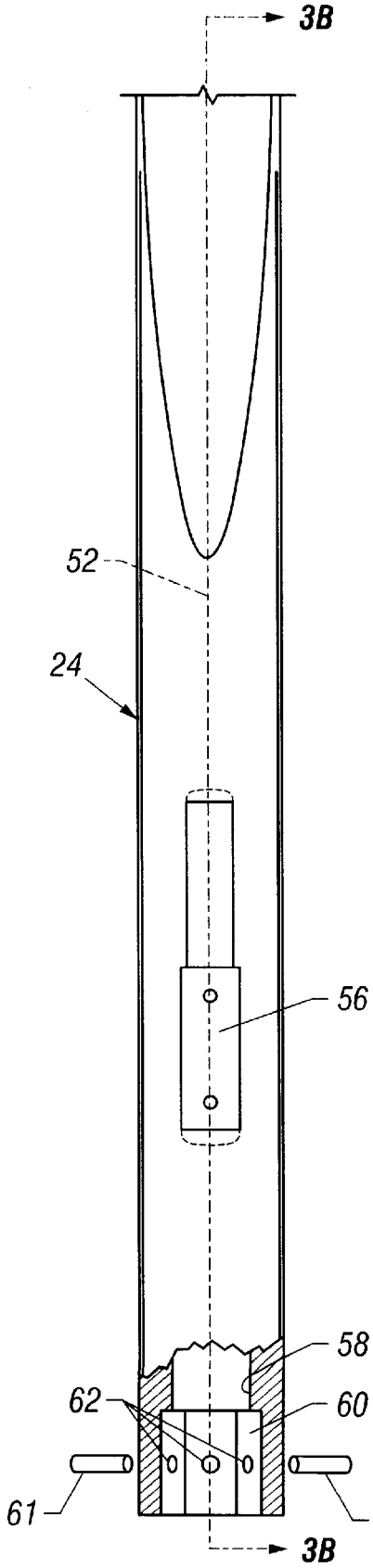
FIG. 3A-b

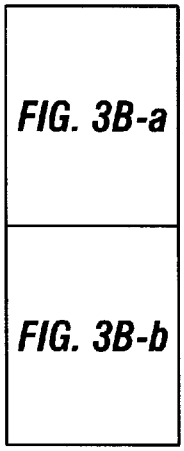
FIG. 3B
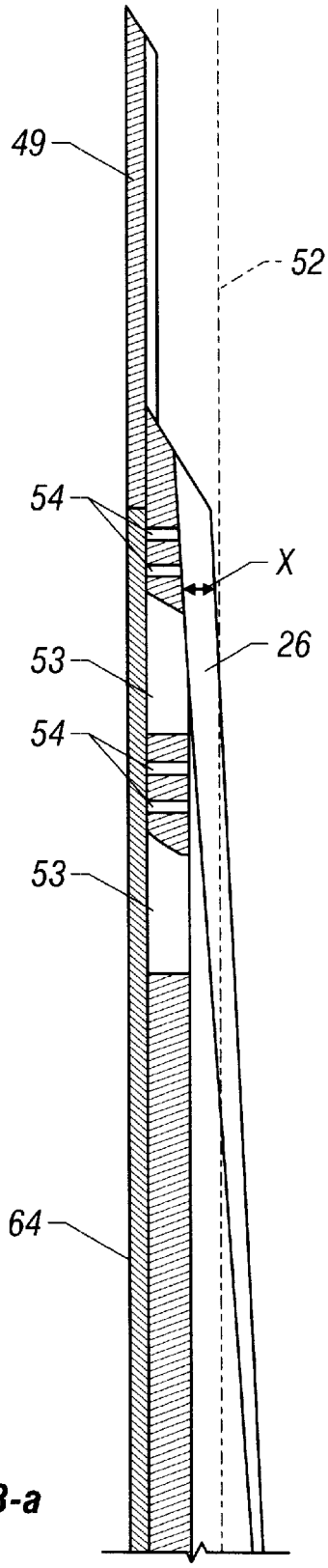
FIG. 3B-a
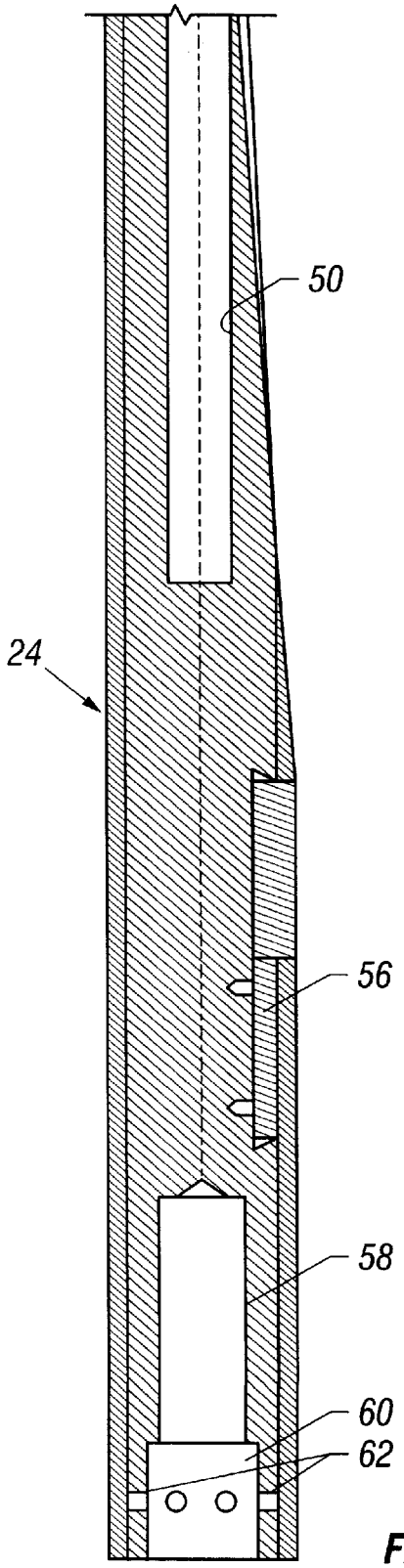
FIG. 3B-b

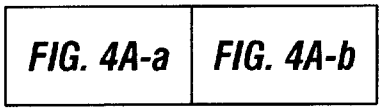
FIG. 4A
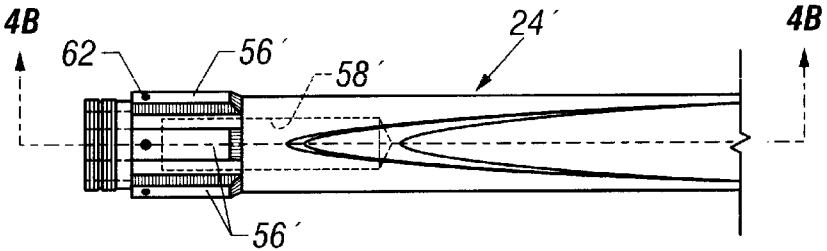
FIG. 4A-a
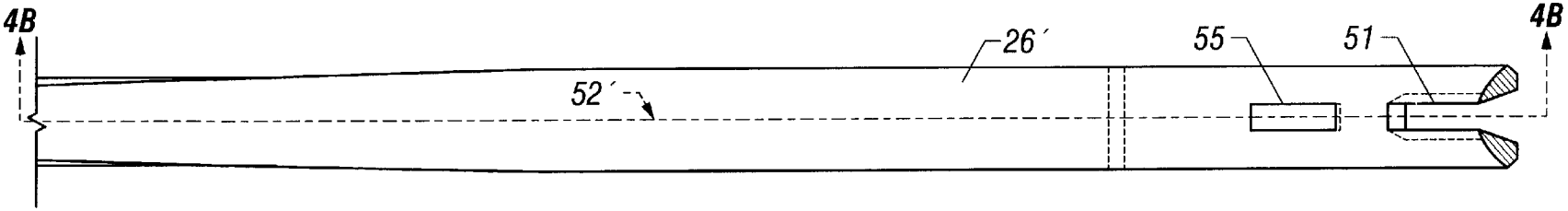
FIG. 4A-b

20′
192
198
190
191
172
184
186
188
193
191
190
200
199′
199′
174
201
202
204
W
199″
206
$ID_b$
208
210
$L_d$
210
222′
219
220
222
212
214″
214
214′
216
218
26′
178
24′
58′
68′
70′
61′
179a
174
173
179
172
28
177a
177
22′

186
20´
207

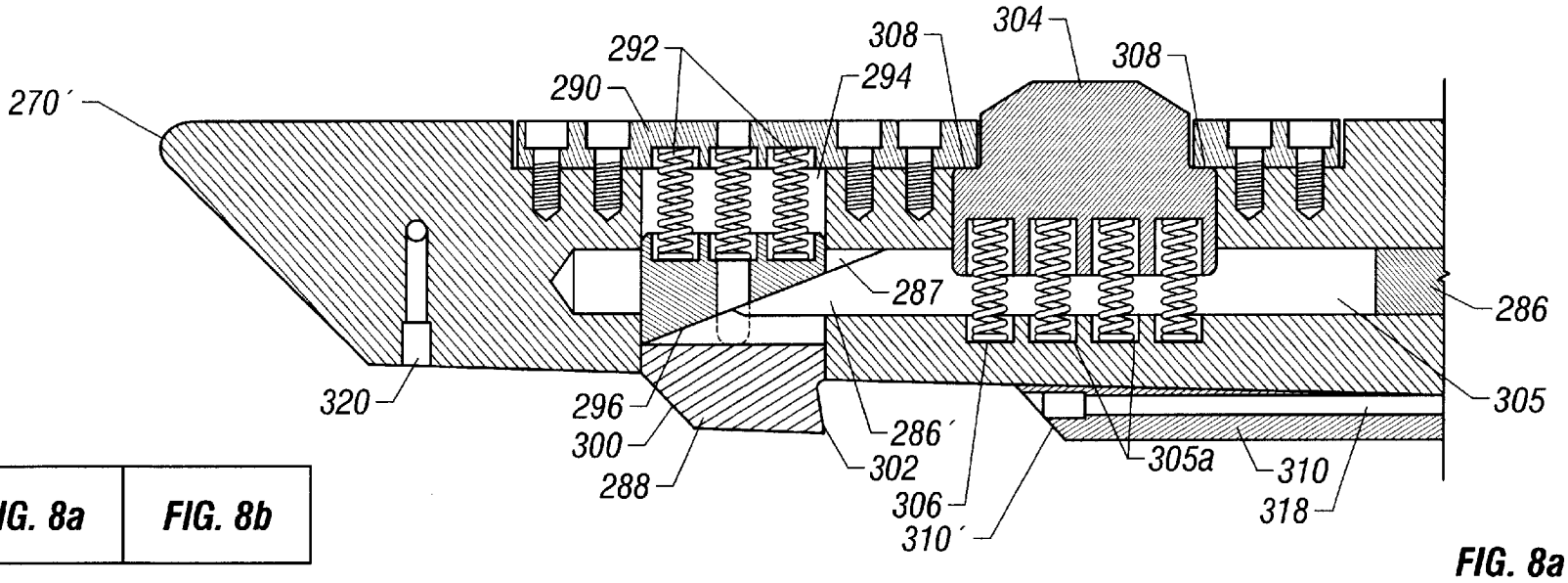
FIG. 8a
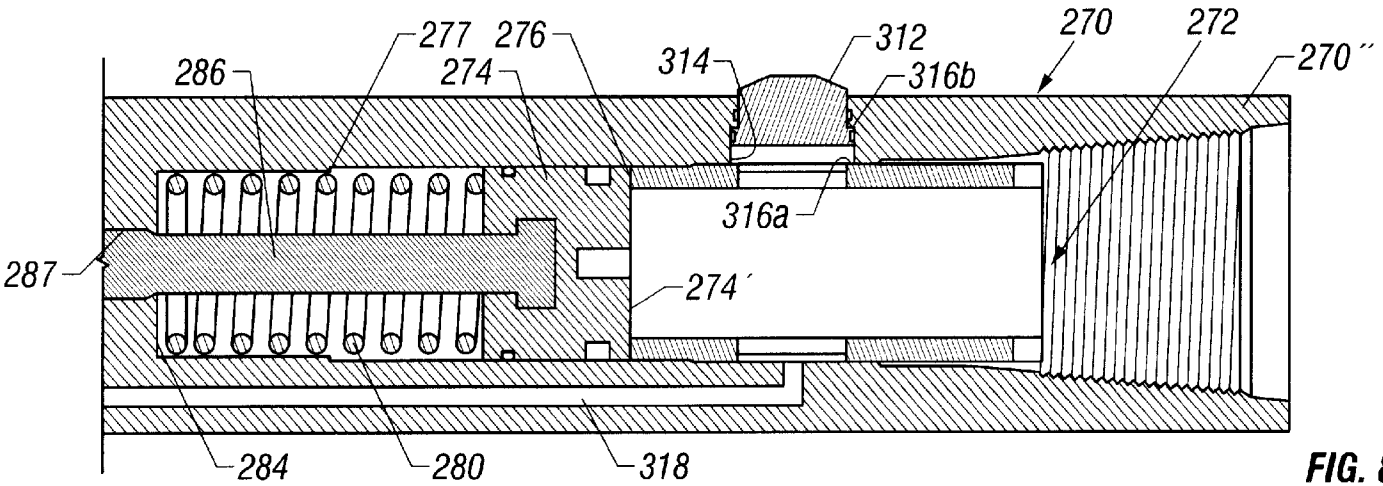
FIG. 8b
| FIG. 8a | FIG. 8b |
|---|---|
FIG. 8

DEVIATED BOREHOLE DRILLING ASSEMBLY

This application is a continuation of U.S. application Ser. No. 09/305,775 filed on Apr. 16, 1999, now U.S. Pat. No. 6,283,208, which is a continuation-in-part of U.S. application Ser. No. 08/923,945 filed on Sep. 5, 1997, now U.S. Pat. No. 6,012,516. The '775 Application also claims the benefit of Canadian Patent Application No. 2,236,047, filed on Apr. 27, 1998, and Canadian Patent Application No. 2,245,342, filed on Aug. 18, 1998.

FIELD OF THE INVENTION

The present invention is directed to a borehole drilling assembly and in particular to an assembly for drilling and completing deviated boreholes.

BACKGROUND OF THE INVENTION

Deviated boreholes are drilled using whipstock assemblies. A whipstock is a device which can be secured in the casing of a well and which has a tapered, sloping upper surface that acts to guide well bore tools along the tapered surface and in a selected direction away from the straight course of the well bore.

To facilitate the use of a whipstock, a section of casing is used which has premilled window openings through which deviated well bores can be drilled. The whipstock can be positioned relative to the window using a landing system which comprises a plurality of stacked spacers mounted on a fixed mounting device at the bottom of the casing and defining at the top thereof a whipstock retaining receptacle, or by use of a latch between the whipstock and the casing. A stacked landing system can cause difficulty in aligning the whipstock with the window opening as the distance between the mounting device and the window increases. The whipstock may also turn during the drilling or setting processes resulting in the deviated well bore being directed incorrectly and/or the well bore tools being stuck in the wellbore. Sometimes a latch system is used to overcome some of these disadvantages. However, the latch can sometimes disengage between the whipstock and the casing, allowing the whipstock to turn or move down in the casing.

After the deviated wellbore is drilled, it can be left uncompleted or completed in any suitable way. To seal the deviated wellbore hydraulically from the main casing, a liner can be installed and cement can be pumped behind the liner. This is expensive and often creates obstructions in the main casing which complicates removal and run of the tools.

When the tools are used in horizontal primary bores, new problems arise. Running and retrieval tools which are useful for vertical tool manipulation are not always useful in horizontal applications.

SUMMARY OF THE INVENTION

An assembly for drilling and/or completing a deviated wellbore has been invented. In one aspect the assembly includes a toolguide which can be positioned relative to a window opening in a casing section and releasably locked in position. The toolguide or portions thereof can have applied thereto a coating which prevents damage to the metal components of the toolguide and facilitates removal of the toolguide from the wellbore after use.

A tool guide for creating deviated borehole branches from a wellbore includes a whipstock including a sloping face portion and a lower orienting section, including at least one latch biased radially outwardly from the orienting section and positioned in a known orientation relative to the sloping face portion and a latch locking means to releasably lock the latch in an extended position, the latch locking means being actuated to lock the latch by torsion of the mandrel within the lower orienting section.

Each latch of the orienting section is selected to fit within and lock into its own latch receiving slot formed in the casing. When the latch of the orienting section is locked into the latch receiving slot the toolguide will be maintained in position in the casing. Preferably, the casing includes at least one premilled window opening positioned in known relation relative to the latch receiving slot. Preferably, a removable liner can be positioned in the casing to close the window opening temporarily and to cover the latch receiving slot.

The orienting section can be releasably connected to the whipstock. Such connection is preferably by connectors such as, for example, shear pins to the whipstock so that these parts can be installed together into the casing. Preferably, the connectors are selected such that the sections can be separated by an application of force sufficient to overcome the strength of the connectors. This permits the whipstock and the lower section to be separated and removed separately should one part become stuck in the casing.

The sections are movable relative to one another and means are provided to translate such movement to actuate such means as a seal.

Preferably, the lower orienting section includes a mandrel engaged slidably and rotatably within an outer housing. The mandrel is releasably connected to the whipstock and moveable with the whipstock. Preferably, the latch locking means is an extension of the mandrel. The extension can be formed to fit behind the latch to lock it in the outwardly biased position.

Another toolguide for creating borehole branches from a wellbore, the toolguide having a longitudinal axis and comprising a whipstock including a sloping face portion, a lower orienting section, the whipstock and the lower orienting section being connected and moveable relative to each other along the longitudinal axis of the toolguide, and an annular sealing means mounted below the whipstock, the annular sealing means being actuatable to expand and retract upon movement of the whipstock and the lower orienting section relative to one another.

The whipstock is attached to a central mandrel of the lower orienting section. The central mandrel is engaged slidably and rotatably within an outer housing of the lower orienting section. The outer housing carries the annular sealing means which is actuatable to expand or retract by movement of the mandrel within the outer housing. Preferably, the outer housing includes a first section and a second section and disposed therebetween the annular sealing means. The first section is moveable toward the second section to compress the annular sealing means therebetween and cause it to expand outwardly. In this embodiment, preferably the mandrel has a shoulder positioned thereon to abut against the first section and limit the movement of the mandrel into the outer housing. Abutment of the shoulder against the first section causes the first section of the housing to be driven it towards the second section and the annular sealing means to be compressed and expanded outwardly.

Previous orienting tools were difficult to use because it was necessary to run the tool to a known depth and then search around for the position of the slot for accepting the latch on the tool. Because the latches of some orienting tools have to be biased outwardly on the trip down into the well, it has been difficult to use the orienting tools in wells, for example, having more than one lateral window and therefore more than one orienting slot for accepting the latch of the tool. To the problem of having the latch lock into the incorrect slot, where multiple slots are present, it has been necessary to shape the slots in the casing such that they will only accept one form of latch. This solution presents logistical problems, however, and limits the number of slots which can reasonably be positioned in the casing.

Thus, in accordance with one broad aspect of the present invention, there is provided an orienting tool for positioning in a well bore casing having a profile positioned therealong, the tool comprising: a body; at least one member mounted on the tool body and biased outwardly, at a selected pressure, therefrom, the selected pressure being great enough to permit determination of when the at least one member has moved past the profile but not being so great as to prevent the at least one member from moving past the profile using normal force.

The at least one member can be a spring loaded dog or an arm such as, for example, a part of a collect, a collar locator or any other means. In preferred embodiment, the at least one member is part of a ring of dogs mounted about a circumference of the tool body and biased outwardly therefrom. The at least one member preferably operates to position the tool at a selected pressure of 20,000 to 30,000 psi. At this pressure, when the member passes a profile, there will be a indicative overpull or decrease in drill string weight.

The at least one member can be biased outwardly by any desired means such as, for example, springs. In a preferred embodiment, the biasing means is selected to exert increased pressure as the depth of the tool is increased. This biasing means is preferred as it provides that less force is required to move the tool through the casing at shallower depths but requires greater force to be moved through the casing when it is at greater depths and, therefore, when there is greater available drill string weight to act on the tool. One such biasing means is sensitive to hydrostatic pressure and applies a pressure to the at least one member which increases with an increase in hydrostatic pressure of the fluids about the tool. It may be necessary to set an upper limit for the selected pressure applied to the at least one member.

The profile and the at least one member are preferably correspondingly positioned so that the at least one member will be affected by the profile regardless of the rotational orientation of the tool within the casing. To avoid forming a protrusion which extends inwardly from the casing inner surface and reduces the ID of the casing, preferably the profile is a groove sized to accept the at least one member there in . In a preferred embodiment, the groove is a radial groove extending about the ID of the casing.

There can be more than one profile along a length of casing. Where more than one profile is present along the casing, the at least one member will be affected by each profile in a similar manner. Preferably, the profiles are non-selective. The specific profile which is affecting the member can be determined using tool depth information, the measurement of which is well known in the art.

Where it is desired, in addition to positioning the tool at a selected orientation along the casing, to position the tool at a selected rotational orientation within the well, the tool can further comprise a latch for fitting into a slot positioned at a selected rotational position about the center axis of the casing. The tool is selected to provide for rotation of at least the portion of the tool carrying the latch to permit the latch to be located in its slot. In one embodiment, the tool body includes a first part carrying the at least one member, a second part carrying the latch and a joint positioned therebetween for permitting the second part to rotate relative to the first part and preferably also to move out of axial alignment with the first part.

The orienting sections according to the present invention can be used to orient whipstocks as well as other tools such as, for example, retrieval tools, sleeve shifting tools and lateral completion tools.

A whipstock for use in creating wellbore branches from a well bore can have a main body formed of a first material of reduced diameter to facilitate washover or engagement by die collars or overshots. The main body has extending out therefrom centralizers such as stand off rings or extensions the main body. Sometimes a coating material is disposed at least over a portion of the main body, the coating material being softer than the first material and being resistant to oil and gas.

In a whipstock having a main body of reduced diameter relative to centralizers formed thereon, it has been found that the width of the sloping face portion is greatly reduced. This reduces the surface area which is available to guide the drill bit or mill off the whipstock face and the mill or drill bit tends to roll off the sloping face portion in the direction of rotation of the drill.

To prevent roll off and to centralize and stabilize the upper tapered end of the whipstock, while continuing to facilitate washover procedures, a whipstock is provided including a main body having an outer surface, a sloping face portion formed on the main body and having a slope angle and an extension formed on the main body about the sloping face such that the diameter of the extension is greater than the diameter of the main body.

Preferably, the extension about the sloping face portion forms an effective diameter which is substantially equal to the drift diameter of the casing into which it is to be used. The extension preferably conforms to the slope angle of the sloping face portion and, where the sloping face portion has a curvature, follows and continues the curvature of the sloping face portion.

The whipstock can include centralizers extending out from the main body. Preferably, the effective diameter of the whipstock at the centralizers is substantially equal to the effective diameter of the whipstock at the extensions.

In one embodiment, the main body has applied thereto a coating, for example of polymeric material. The coating material can be applied against the extension and the centralizers, if any.

Running and retrieving tools are required for moving the tools through the well bore. Previous running tools for whipstocks used shear bolts for attachment between the running tool and the whipstock. These shear bolts are prone to shearing prematurely if the whipstock is bumped at surface while entering the will or sue to running the assembly through a tight area in the casing. The shear bolt may also shear prematurely if the assembly is rotated.

A new tool has been invented which is positively latchable to the whipstock in a manner that allows forces to be applied upwardly or downwardly as well as rotationally without risk of prematurely releasing the whipstock. At the desired time of release, hydraulic pressure is applied to the tool to unlatch it from the whipstock.

In accordance with a broad aspect of the invention, therefore, there is provided a running/retrieval tool for moving a well tool through a well bore casing, the running/retrieval tool comprising: a body; a latch for releasably engaging the well tool and being driven to move between a retracted position recessed in the body and an extended position in which a portion of the latch extends from the body; and a guide selected to act against the well tool to guide the latch into engagement with the well tool.

The latch can be driven between the retracted position and the extended position by any desired means. Preferably, the drive means for the latch can be controlled from surface and can be, for example, a hydraulic system.

The guide is formed on the tool and can be selected to engage with the well tool in such a way as to transmit rotational energy to the well tool. A key can be provided on the tool to assist in the location of the tool relative to a well tool to be retrieved. In a preferred embodiment, an outwardly biased key is provided which is engage able into an orienting slot formed on the casing section adjacent the mounting position of the well tool to be used with the running retrieval tool.

In another embodiment, the running/retrieval tool according to the present invention includes a outwardly extendable and retractable key useful for applying force against the casing in which the tool is positioned to urge it toward one side of the casing. The key can be extendable by a hydraulic system.

A casing section for a deviated wellbore junction comprises a cylindrical casing tube having a central axis and a window opening formed therein. A sleeve having an opening therein is mounted relative to the casing tube to move between a first position in which the opening of the sleeve is aligned with the window opening of the casing tube and a second position in which the opening of the sleeve is not aligned with the window opening of the casing tube.

Another casing section for a deviated wellbore junction includes a casing tube having a central axis and a window opening formed therein. A sleeve having a first opening and a second opening therein is mounted relative to the casing tube to move between a first position in which the first opening of the sleeve is aligned with the window opening of the casing tube and a second position in which the second opening of the sleeve is aligned with the window opening of the casing tube.

Preferably, sealing means are disposed between the casing tube and the sleeve. These sealing means are preferably selected to effect a hydraulic seal between the parts. In one embodiment, the sealing means are formed of deformable materials such as rubber or plastic and is disposed around the opening of the sleeve and along the top and bottom thereof.

In a preferred embodiment, the sleeve has formed therethrough two openings. The first opening is sized to allow access to the window opening of the casing section by deviated borehole tools and the second opening is smaller than the first opening.

In one embodiment, the sleeve is disposed within the casing tube in a counterbore formed therein such that the inner diameter of the sleeve is greater than or substantially equal to the inner diameter of the casing away from the position of the sleeve.

Preferably, the window of the casing is formed to accept a flange of a junction fitting such as, for example, a tieback hanger of a branched weilbore. In a preferred embodiment, the sleeve is selected to seal against the flange of the fitting.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIG. 3A is a view showing the orientation of FIGS. 3A–*a* and 3A–*b;*

FIGS. 3A–*a* and 3A–*b* are a front elevation view, partly cutaway, of a whipstock of a toolguide according to the present invention;

FIG. 3B is a view showing the orientation of FIGS. 3B–*a* and 3B–*b;*

FIGS. 3B–*a* and 3B–*b* are a section along line 3B—3B of FIG. 3A;

FIG. 4A is a view showing the orientation of FIGS. 4A–*a* and 4A–*b;*

FIGS. 4A–*a* and 4A–*b* are a front elevation view, partly cutaway, of a whipstock of another toolguide;

FIG. 4B is a view showing the orientation of FIGS. 4B–*a* and 4B–*b;*

FIGS. 4B–*a* and 4B–*b* are a section along line 4B—4B of FIG. 4A;

FIGS. 4C and 4D are sectional views along line 4C—4C and 4D—4D, respectively, of FIG. 4B;

FIG. 4E is a bottom end view of FIG. 4A;

FIG. 4F is a top end view of FIG. 4A;

FIGS. 6A*a* and 6A*b* are longitudinal sections along another lower section of a toolguide in a set configuration;

FIGS. 6B*a* and 6B*b* are longitudinal sections along another lower section of a toolguide;

FIG. 8 is a view showing the orientation of FIGS. 8*a* and 8*b;*

FIGS. 8*a* and 8*b* are longitudinal sectional views along a running/retrieving tool;

DETAILED DESCRIPTION OF THE PREFERRED EMBODIMENTS

Figure 1:
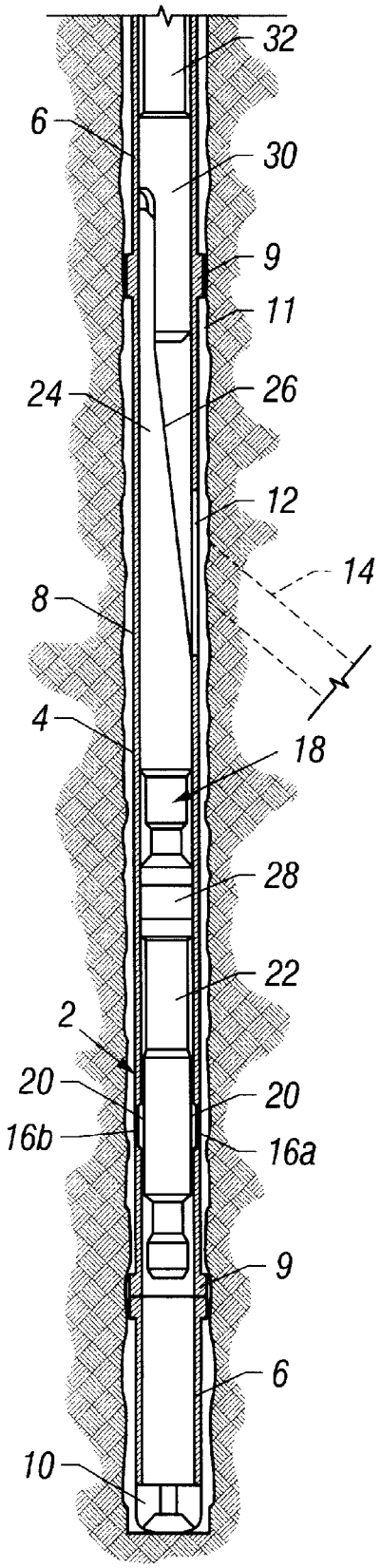
FIG. 1 is a schematic representation of an embodiment of an assembly according to the present invention, the assembly being positioned in a wellbore.

For the purposes of clarity, in the Figures only reference numerals of the main components are indicated and like reference numerals relate to like components.

Referring to FIG. 1, there is a shown a tubular wellbore casing 2 for installation in a primary wellbore 4 drilled through a formation. Primary wellbore 4 can be a main wellbore directly opening to surface or a lateral wellbore drilled from a main wellbore. Primary wellbore can range between a vertical and a horizontal orientation. Casing 2 includes upper and lower sections of production casing 6 and secured therebetween a casing section 8 for use in deviated wellbore junctions. The deviated wellbores branch from wellbore 4.

Casing sections 6 and 8 are connected by standard connectors 9 or any other suitable means. A float collar 10 is provided at the lower end of casing 2 which allows fluids to flow out of the casing but prevents flow of fluid and debris back into wellbore casing 2. Any similar one way valve can be used in the place of float collar 10. By a completion procedure, cement 11 is disposed in the casing annulus.

Casing section 8 includes a window in the form of an elongated opening 12 extending in the longitudinal direction of casing 8. In use, opening 12 is oriented toward the desired direction of a deviated wellbore to be drilled, shown in phantom at 14. The window is sized and shaped with reference to the desired diameter and azimuth of the deviated wellbore to be drilled and the diameter of the casing, as is known in the art.

Casing section 8 further has formed therein a latch receiving slot 16*a* at a selected orientation relative to window opening 12. The latch receiving slot can be oriented at any point around the interior circumference of the casing section, so long as its position is known with respect to the window opening. Preferably, latch receiving slot 16*a* is aligned with the longitudinal axis of window 12, as shown, or is directly opposite window opening 12.

A toolguide 18 is installed in casing 2 with its latch 20 extending into slot 16*a*. Toolguide 18 includes a lower orienting section 22, also called a monopositioning tool, from which latch 20 is biased radially outwardly, and a whipstock 24 having a sloping face portion 26. Sections 22 and 24 are connected so that they are not free to rotate relative to each other, whereby face portion 26 is maintained in a fixed and known orientation relative to latch 20. In a preferred embodiment, as shown, latch 20 is aligned at the bottom of sloping face portion 26, so that the surface of the sloping face portion will be aligned opposite window opening 12, when latch 20 is in slot 16*a*.

An annular expandable seal 28 is disposed on toolguide 18 below sloping face portion 26. The seal 28 when expanded, acts to prevent debris and fluids from passing down the wellbore. Seal 28 is, therefore, selected to have an outer diameter, when expanded, which is greater than the inner diameter of the casing in which it is to be used.

Toolguide 18 is placed in casing 2 by use of a running tool 30 which releasably locks onto whipstock 24 and is shown in this drawing still attached to the whipstock. Running tool 30 is connected to a drill pipe 32.

To remove the toolguide from the wellbore, a retrieving tool can be used. FIG. 8, show a tool that is useful for both running and retrieving operations.

Figure 2:
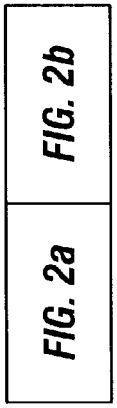
FIG. 2 is a view showing the orientation of FIGS. 2*a* and 2*b*.
Figure 2A:
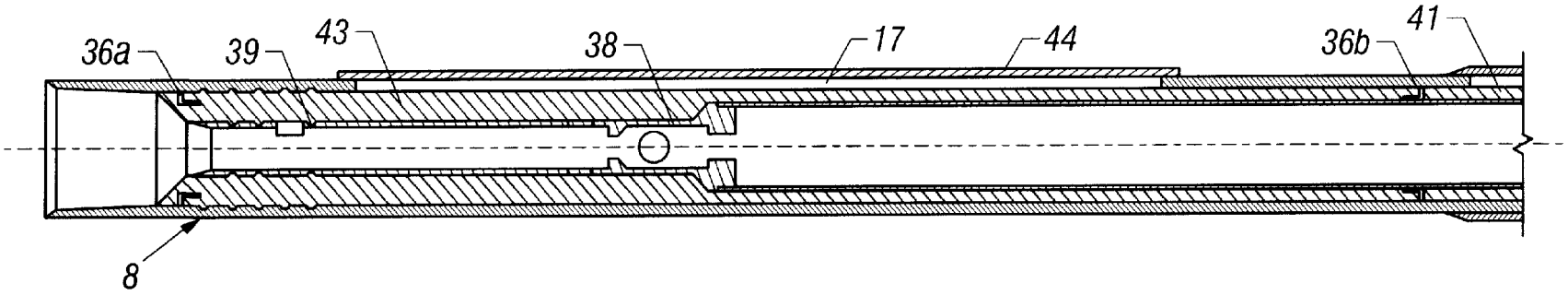
FIGS. 2*a* and 2*b* are a longitudinal section along a casing section for a deviated wellbore junction useful in the present invention.
Figure 2B:
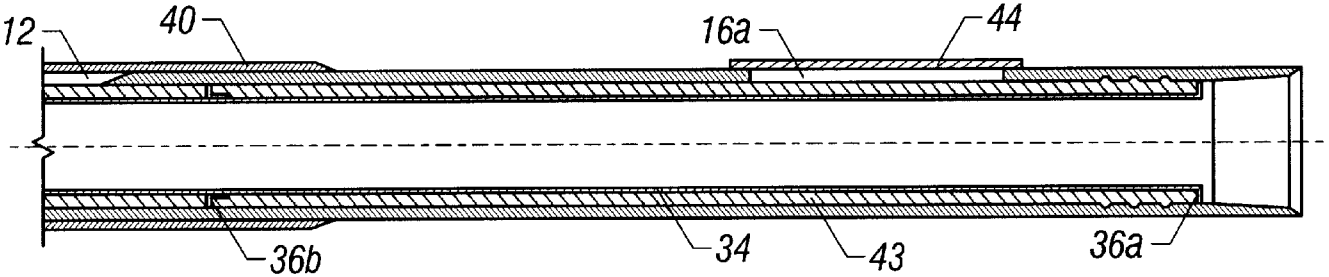

To prepare for the drilling of a deviated borehole, such as that shown at 14, the wellbore casing 2 is installed and completed. FIG. 2 shows apparatus useful for permitting completion of the well while preserving features used in the invention. Casing section 8 is milled to include a window opening 12 and a latch receiving slot 16*a*. Preferably, a slot 17 (FIG. 2) for alignment of retrieval tools is also milled out in casing section 8. Preferably, window opening 12 and latch receiving slot 16*a* are aligned along the casing.

A liner 34 is positioned in casing 8 and seals 36*a* and 36*b* are provided between liner 34 and casing 8. A float collar 38 and an orienting subassembly 39 are attached above liner 34. Float collar 38 and orienting subassembly 39 can be positioned, as shown, or can be positioned further up the casing provided orienting subassembly is in a known configuration relative to window opining 12. Preferably, a removable filler 41 which is selected to withstand high downhole hydrostatic pressures, such as high density polyurethane or cement, is inserted between casing 8 and liner 34 between seals 36*b* to fill window opening 12 and the casing section 8 is wrapped in a rigid material 40, such as fibre glass or composite tape, to cover at least opening 12.

Preferably, slots 16*a* and 17 are filled with liquid or easily removable filling materials such as grease and/or foam to prevent materials from entering into the slots and the remainder of spaces 43, defined between casing 8, liner 34 and seals 36*a*, 36*b*, are filled with cement. To further prevent entry of materials into slots 16*a*, 17, caps 44 are welded onto the outer surface of casing 8 over the slots.

Casing 8, including the parts as noted hereinbefore, is connected to casing sections 6 to form casing string 2 and float collar 10 is attached. Casing string 2 is lowered into wellbore 4. The casing string is rotated until window opening 12 is oriented in the direction in which it is desired that the deviated wellbore 14 should extend. Suitable methods are well known in the oil and gas industry for orienting downhole tools. As an example, a surface reading gyro, a mule shoe or other suitable means can be used.

The cased wellbore is completed by forcing cement through the casing string and into the annulus between the casing and the wellbore. During completion, the cement is force d through float collar 38 and liner 34 but is prevented from moving behind liner 34 by seals 36*a* and the cement and fillers in spaces 43. As the cement fills the casing annulus, it is prevented from entering slot 16*a* by cap 44 and is prevented from entering window opening 12 by the filler 41 and rigid materials 40. The cement is allowed time to set.

After completion, a drill (not shown) of a diameter selected to be approximately equal to the inner diameter of the casing is run into the well to remove cement from the casing bore. The drill will also drill out liner 34, seals 36*a*, 36*b*, float collar 38 and cement in spaces 43. Thus, liner 34 is formed of a material such as, for example, aluminum, fibre glass, or carbon fibre-containing composite, which can be removed by drilling or by any other method without having to retrieve to surface. Where aluminum is used in the wellbore, preferably any aluminum surfaces which are exposed and will be contacted by the cement used in the completion operation, are coated with a suitable material, such as rubber cement, to improve the bond of the cement to the aluminum.

The casing is then ready for production or for drilling deviated wellbores. Where deviated wellbores are to be drilled a toolguide 18 will be run in and oriented in the casing as shown in FIG. 1.

In FIGS. 3A and 3B and FIGS. 4A to 4F, two embodiments of a whipstock are shown. Referring to FIGS. 3A and 3B, a whipstock 24 tapers toward its upper end to form a sloping, ramped face portion 26 which is formed to direct any tool pushed along it laterally outwardly at a selected angle. The face portion is machined to have a selected slope x or range of slopes with respect to long axis 52 of the section depending on the build radius desired for the deviated wellbore. As an example, when x is 4/, the build radius will be approximately 15°/30 meters drilled. Preferably, sloping face portion 26 is formed to be concave along its width.

An entry guide 49 is welded at the top of face portion 26. Entry guide 49 assists in centralization and tool retrieval and need only be used, as desired. A bore 50 extends a selected distance through the whipstock parallel to its central axis 52. Bore 50 is formed to engage a fishing spear device and provides one means of retrieving the toolguide from the wellbore. Extending back from face portion are slots 53 formed to accept and retain a retrieval tool having corresponding sized and spaced hooks thereon. Also formed on face portion 26 are apertures 54 formed to accept shear pins (not shown) for attachment to running tool 30 (FIG. 1).

Centralizers 56 are spaced about the whipstock. While only one centralizer is illustrated in the drawing, there are preferably at least three centralizers on the upper portion to center the whipstock in the hole. The centralizers can take other forms, as desired.

A socket 58 extends from the bottom of whipstock 24 parallel with central axis 52. Socket 58 is shaped to accept a male portion 68 on the lower orienting section 22, as will be discussed hereinafter with reference to FIGS. 5A and 5B. Preferably, socket 58 is faceted at 60 and male portion 68 is similarly faceted so that the parts lock together and male portion 68 cannot rotate within socket 58. Shear pins 61 are inserted through apertures 62 to secure male portion 68 in socket 58 and thereby, the whipstock to the lower section.

The whipstock is formed of hardened steel and has applied thereto a polymeric coating 64 (shown only in FIG. 3B). Polymeric coating 64 is, preferably, formed of cured polyurethane but can be formed of other polymers such as epoxy. Coating 64 acts to prevent damage of the metal components of the whipstock and can be reapplied if it is removed during use. Coating 64 further facilitates wash over operations, should they become necessary, to remove the toolguide or whipstock from the casing. The coating is thick enough so that it will accommodate normal damage from, for example, abrasion and will prevent damage to the metal surfaces of the whipstock and is preferably also thick enough so that substantially only the coating will be removed by any washover operation. In a preferred embodiment, the coating is about ½ inch thick and is applied using a mold, so that the shape of the tool after coating is controllable. If damage occurs to the coating, it can be replaced.

The maximum outer diameter of the whipstock to the outer surface of the coating is selected to be smaller than the inner diameter of the casing in which it is to be used. In particular, the maximum effective outer diameter of the whipstock is selected to be as large as possible without exceeding the drift diameter (i.e. the maximum diameter permitted according to regulations for any tool for use in a casing of a particular id) for the casing.

Because coating 64 is easily abraded and, to a limited degree, deformable, the coating can interfere with tool centralization. Thus, to permit correct centralization of the whipstock within the casing, preferably centralizers 56 extend out from the metal portion of the whipstock a distance at least equal with the thickness of coating 64. In this way, centralizers 56 are either flush with the surface of the coating or extend out therefrom.

Referring to FIGS. 4A to 4F, another whipstock 24' is shown. Whipstock 24' includes a sloping face portion 26'. Generally, whipstocks are useful for producing deviated wellbores having only a selected one of a long, medium or short radius deviated wellbore. However, the profile of sloping face portion 26' of whipstock 24' is formed to allow flexibility to produce both medium and short radius laterals.

Whipstock 24' is selected to be useful with a running/retrieval tool as is described in more detail in FIG. 8. In particular, whipstock 24' has formed at its upper end a dove-tail slot 51 and a second slot 55. These slots will be described in more detail with respect to FIG. 8.

Centralizers 56' are formed integral with the metal portion of the whipstock. While six centralizers are shown, it is to be understood that only three centralizers are required for proper functioning.

Whipstock 24' includes a socket 58' which is generally similar to socket 58 described with reference to FIG. 3B. Socket 58' includes a faceted portion 68. Apertures 62 extend through centralizers 56' and open into socket 58' for accepting shear pins (61' in FIG. 6A) for securing the whipstock to the lower section.

A coating 64' of polymeric material is applied over selected portions of whipstock 24'. As noted with respect to FIG. 3B, preferably coating 64' is applied to be flush with the outer, contact surface of centralizers 56'. The effective diameter of the whipstock to the outer surface of the coating is substantially the same as the effective diameter of the whipstock at the centralizers, which is selected to be equal to or just less than the drift diameter of the casing in which whipstock is to be used.

In using whipstocks that are of a reduced diameter and have applied thereover or attached thereto coatings or brass stand-off rings or that have been modified in other ways to facilitate washover or engagement by die collars or overshots, it has been found that the surface area of the sloping face portion is greatly reduced. This reduces the surface area which is available to guide the drill bit or mill off the whipstock face and the mill or drill bit tends to roll off the sloping face portion in the direction of rotation.

To prevent roll off and to centralize and stabilize the upper tapered end of the whipstock, while continuing to facilitate washover procedures, the surface area of face portion 26' is increased by an extension 65 which extends around face portion. Extension 65 acts to extend the width of face portion 26' such that the effective diameter of the whipstock at the extension 65 is equal to or just less than the drift diameter for the whipstock which is substantially equal to the effective diameter at the centralizers. A cavity is formed on the outer surface of the whipstock between the centralizers and the extension into which coating 64' is applied. The radial length of the whipstock relative to the long axis 52' is selected to be substantially equal along the length of the whipstock. As an example, in the preferred embodiment, the radial length r1 at the extension, the radial length to the outer surface of a coated area r2 and the radial length to the outer contact surface of a centralizer 56' r3 are each substantially equal. The extension is preferably ½" to 1" thick.

Figures 4B, 4C, 4D, 4E, 4F:
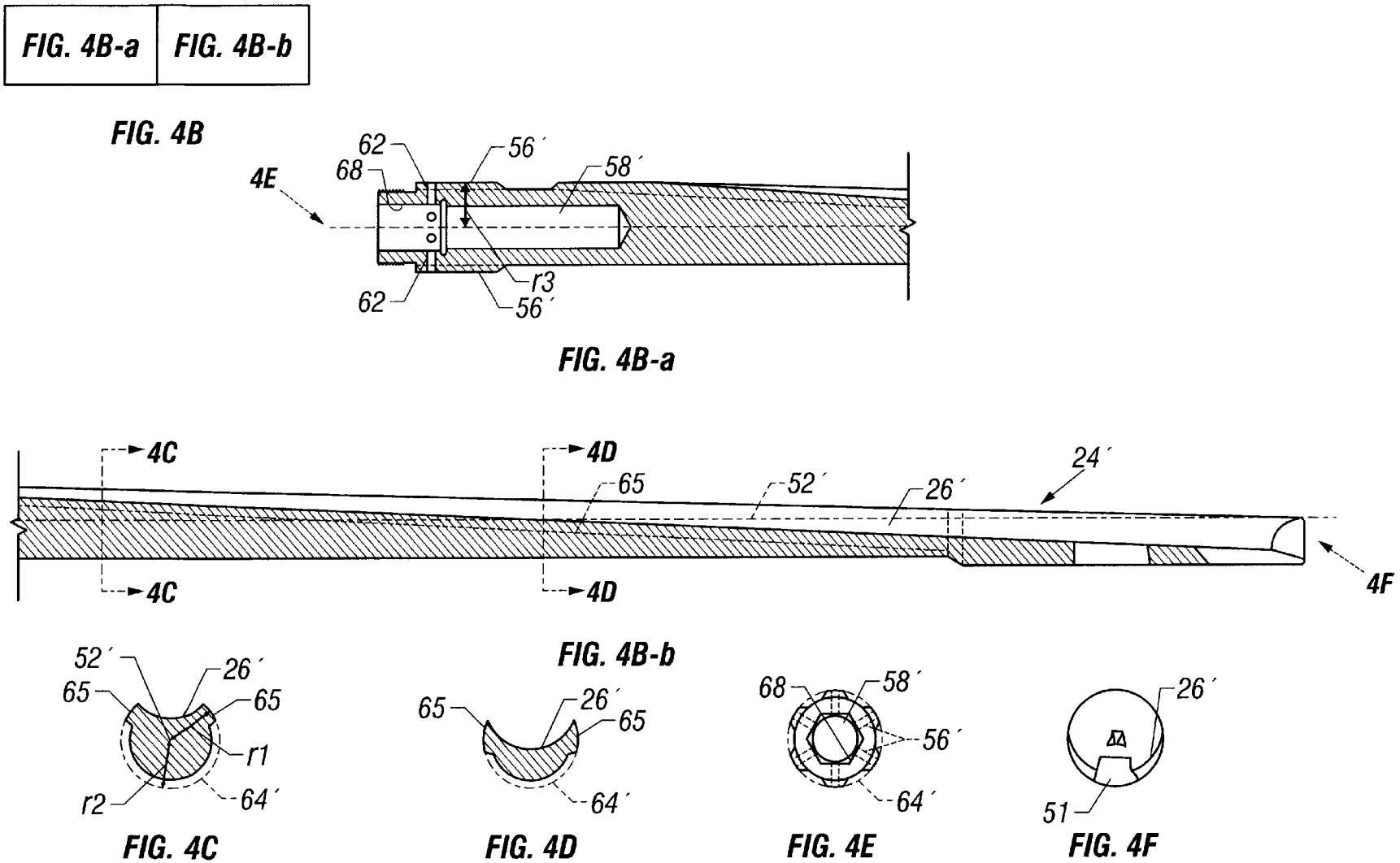
Figure 5A:
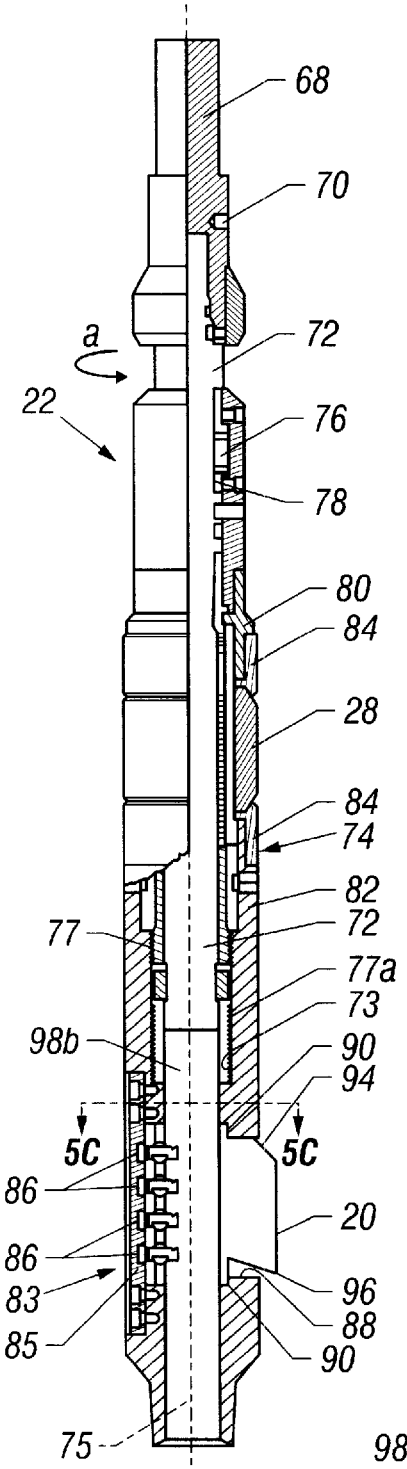
FIG. 5A is a front elevation view of a lower section of a toolguide according to the present invention, partly in section and in un-compressed configuration.
Figure 5B:
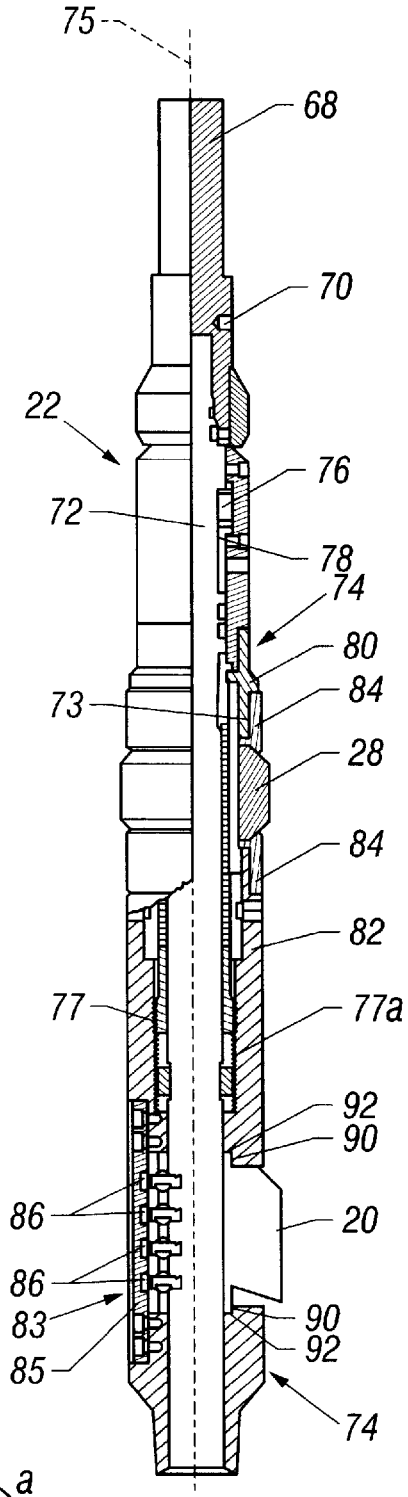
FIG. 5B is a front elevation view of the toolguide of FIG. 5A in compressed configuration.
Figure 6A:
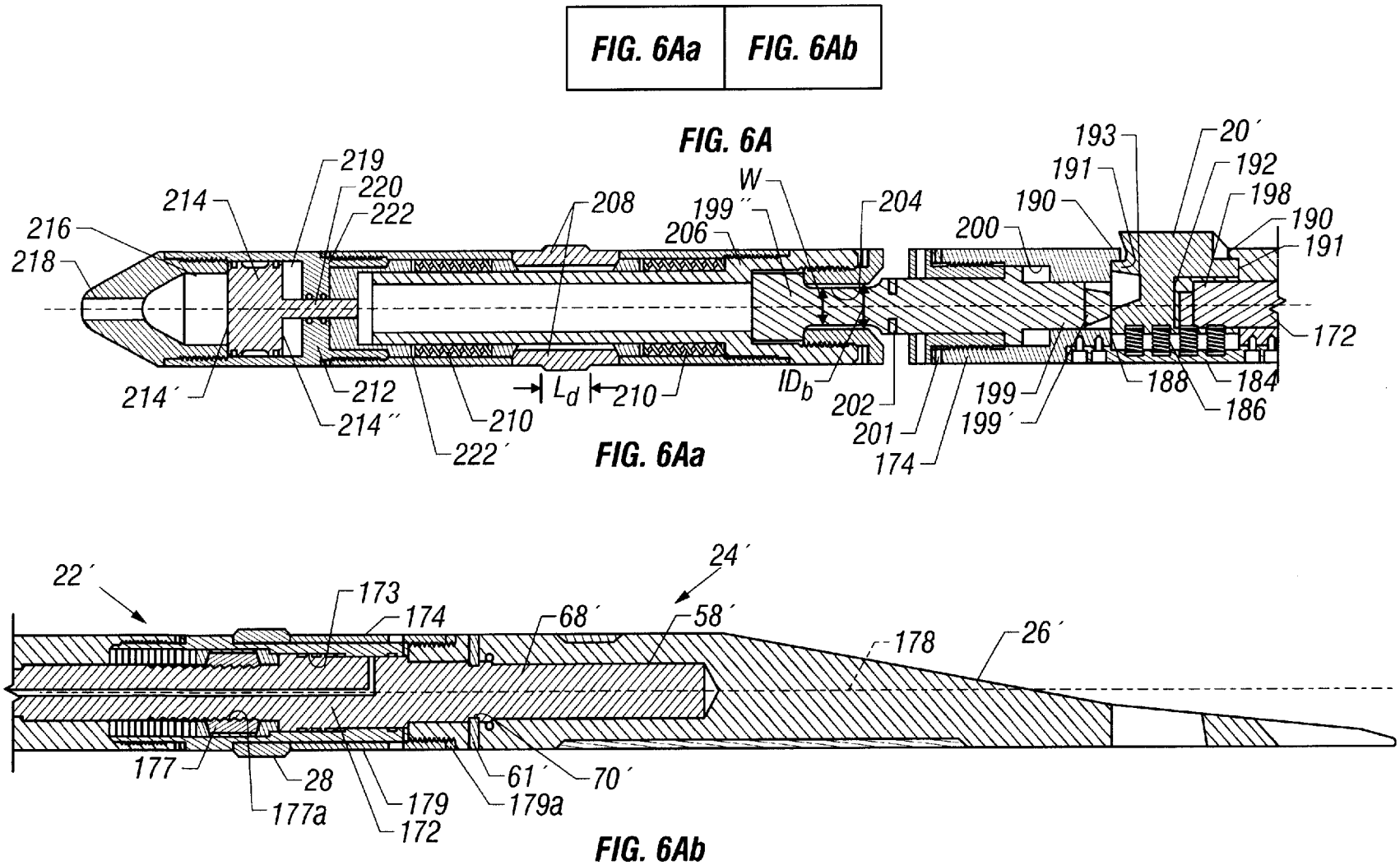
FIG. 6A is a view showing the orientation of FIGS. 6A*a* and 6A*b;*

In FIGS. 5A and 5B, one embodiment of a lower orienting section 22 is shown. FIG. 6A show another embodiment of a lower orienting section 22'. Orienting sections 22 or 22' can be utilized to position and orient any assembly in any desired depth profile included in the casing string. This may include whipstocks, for example as shown in FIG. 3A or FIG. 4A, packers, completion diverters or tubing splitters or any other completion tools required to be oriented in a particular location in the casing, such as for example, adjacent a lateral window.

Section 22 is shown uncompressed in FIG. 5A. In FIG. 5B, section 22 is shown in a compressed, set condition as would be the condition of the section when used in a toolguide which is locked in position in a wellbore ready for use. Lower orienting section 22 includes a male portion 68 shaped to fit into the sockets 58 or 58' on the whipstocks. Bores 70 (only one is shown) accept ends of shear pins 61.

Male portion 68 is connected to a central mandrel 72. Central mandrel 72 is mounted in a bore 73 in a housing 74. Mandrel 72 is both moveable through and rotatable within bore 73 as limited by movement of pin 76 on housing 74 in jay slot 78 formed in mandrel 72. Mandrel 72 can be releasably locked in position in housing by locking collect 77 frictionally engaging into knurled area 77*a*.

Housing 74 includes a top portion 80 and a lower portion 82. Each portion has a flange 84 which together retain an annular packing seal 28. Top portion 80 is moveable towards lower portion 82 as shown in FIG. 5B to compress packing seal 28 and cause it to expand outwardly.

Figure 5C:
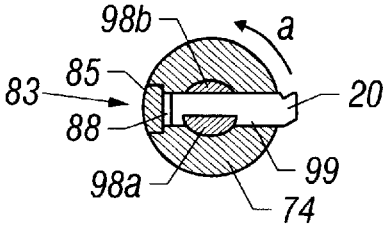
FIG. 5C is a section along line 5C—5C of FIG. 5A.

Referring also to FIG. 5C, housing 74 at its lower end accommodates latch assembly 83. Latch assembly 83 includes latch 20, a latch retaining plate 85 and springs 86. Springs 86 act between latch 20 and latch retaining plate 85 to bias latch 20 radially outwardly from housing 74. Latch 20 is retained in a channel 88 through housing 74 which opens into bore 73. Latch 20 is prevented from being forced by the action of springs 86 out of the channel, by abutting flanges 90 which act against shoulders 92 on the latch. Latch 20 can be pushed into channel 88 by application of force on the latch toward plate 85.

Latch 20 is formed to fit into latch retaining slot 16*a* on casing 8 and has a ramped surface 94 on its upper edge, to ease removal from the slot, and an acute angle portion 96 which acts as a catch to resist against the latch moving out of the slot by any downward force. Mandrel 72 is bifurcated at is lower end to form two arms 98*a*, 98*b*. Arms 98*a*, 98*b* are formed to be extendable through bore 73 on either side of latch 20. Arms 98*a*, 98*b* are generally wedge-shaped to permit rotation of mandrel 72 in bore 73. As mandrel rotates, arms 98*a*, 98*b* are driven from a position in which they do not restrict movement of the latch in the channel to a position in which arm 98*a* abuts against shoulder 99 of latch 20 and prevents it from moving back into channel 88. In this way arm 98*a* can be moved to act as a lock against retraction of latch 20 into channel 88. Arm 98*b* serves to stabilize the end of the mandrel, but, can be omitted from the mandrel, as desired.

In use, a toolguide is constructed by attaching a whipstock (ie. FIG. 3A or FIG. 4A) to lower section 22 by insertion of shear pins 61 through apertures 62 and 70. The toolguide is run into the well until the latch 20 is about 1 meter below the slot 16*a* in casing section 8. The toolguide is hoisted and rotated slowly, until latch 20 is located in slot 16*a*. When the latch is located in the slot, the torque load will suddenly increase. As the string torques up, jay pin 76 will release, allowing mandrel 72 to rotate in a direction indicated by arrow a. When the force on the toolguide is released, the mandrel will be free to move down in housing 74 (FIG. 5B). During rotation of the mandrel, arms 98*a*, 98*b* will be rotated so that arm 98*a* abuts against shoulder 99 of latch 20 and locks latch in the outwardly biased position. Mandrel arms can take other forms provided they are formed to lock behind the latch in response to rotation of the mandrel and/or movement of the mandrel through the housing.

A downward movement of the string allows the toolguide to travel down until portion 96 of the latch lands against the bottom of slot 16*a*. Latch 20 and housing 74 will support the weight of the tool and upper portion of the housing will be driven down by the weight of the whipstock to compress seal 28 allowing it to set. The set force is locked in by collect 77. The whipstock 24 is now aligned with window opening 12 and the directional drilling operations can begin.

After the directional drilling operations are completed, a retrieving tool is run in to retrieve the toolguide. Preferably, in the simplest retrieval procedure, a straight upward force, for example of about 20,000 psi on the toolguide will unlock locking collet 77 and permit mandrel 72 to be pulled up. This pulls arm 98*a* out of abutting engagement with the latch and releases seal 28. The toolguide can then be removed from the well.

If the toolguide gets stuck in the well, a force is applied which is sufficient to shear pins 61 so that the whipstock can be removed separately from the lower section.

Referring to FIG. 6A, another lower section 22' is shown. Lower section 22' is illustrated connected to a whipstock 24'. Lower section 22' includes a male portion 68' shaped to fit into socket 58' of whipstock 24'. Bores 70' accept ends of shear pins 61'.

Male portion 68' is an extension of a mandrel 172 which is positioned in a bore 173 in housing 174. Mandrel 172 is slidably moveable through bore 173 along long axis 178 of the lower section, but can be releasably locked against longitudinal sliding movement by frictional engagement of locking collet 177 against knurled portion 177*a* of the mandrel. Mandrel 172 and bore 173 are correspondingly faceted along corresponding portions of their length to substantially prevent rotational movement of mandrel 172 within bore 173.

An annular packing seal 28 is retained on housing 174 and a tube 179 is positioned to ride over an upper surface of housing 174. Tube 179 is releasably secured through shear pins 179*a* to whipstock 24' to move therewith. Pressure of tube 179 against annular packing seal 28, for example when the weight of the whipstock is released onto the lower section, compresses the seal and causes it to expand outwardly.

Lower section 22' carries a latch assembly including a latch 20', a latch retaining plate 184 and latch biasing springs 186. Springs 186 act between latch 20' and plate 184 to bias latch 20' to extend radially outwardly from housing 174. Latch 20' is formed to fit into a latch retaining slot, such as slot 16*a* in FIG. 1.

Latch 20' is retained in a channel 188 which opens into bore 173. Latch 20' is prevented from being forced by the action of springs 186 out of channel 188 by abutting flanges 190 which act against shoulders 191 on the latch. Latch 20' has formed into its surface an upper cavity 192 and a lower cavity 193.

Mandrel 172 has an extension 198 on its lower end which is capable of fitting into cavity 192 when mandrel is moved toward the latch. When extension 198 of mandrel 172 fits into the cavity, latch 20' is prevented from moving back into channel 188 and, thereby is locked in an outwardly extending position. To strengthen the locking of latch 20' in the outward position, the latch preferably has formed thereon a cavity on each side thereof for accepting a pair of spaced extensions on the mandrel.

A rod 199 extends below latch 20 in a bore 200. Rod 199 is slidably moveable in bore 200 and the rod and the bore are correspondingly faceted along at least a portion of their lengths so that rod 199 is substantially prevented from rotating within the bore. Rod 199 has an end 199' which is capable of fitting into lower cavity 193 on latch 20'. End 199' is tapered to facilitate entry into lower cavity 193 even when the rod end and the cavity are not directly aligned, but cavity is formed such that when latch 20' is biased outwardly into a slot in the casing, end 199' will not align with and fit into the cavity. When end 199' is inserted into cavity 193, the latch is maintained in a recessed position in the channel and is prevented from being biased to extend fully outwardly. Thus, rod 199 acts as a lock for maintaining latch 20' in a recessed position within channel 188. Apertures 201 are formed through housing 174 for alignment with holes 202 on rod 199. Shear pins (not shown) can be inserted through apertures 201 into holes 202 to releasably lock rod 199 against slidable movement in bore 200. Other releasably lockable means can be used in place of shear pins such as spring biased pins or a locking collet. A releasable locking means which can be repeated locked and unlocked is preferred where the tool is to be repeatedly used downhole without being brought back to surface.

Rod 199 extends out of housing 174 and opposite rod end 199" is retained in a bore 204 formed in a lower housing 206. A portion of end 199" is enlarged so that rod is retained in the bore. However, bore 204 is selected to have a greater inner diameter, $ID_b$, than the width, w, of end 199" so that rod 199 can move laterally within bore 204. This forms a wobble shaft arrangement and provides that housing section 206 can move out of axial alignment with axis 178 of housing 174.

Housing 206 houses an orienting assembly including a plurality of orienting dogs 208. Preferably, there are four orienting dogs spaced apart 90 degrees aligned around a circumference of the housing. Dogs 208 are retained in housing in any suitable way such as by abutting flanges, not shown. Dogs 208 are biased outwardly by springs 210, such as Belleville washers, which are actuated to apply various, selectable degrees of force to the dogs. Springs 210 are actuated to vary their biasing force by a hydrostatic piston assembly 212. In particular, piston 212 includes a piston 214 having a face 214' in communication with a chamber 216 opening though aperture 218 to the exterior of the tool. Opposite face 214" of the piston is open to a chamber 219 containing a fluid selected to be at a pressure generally corresponding to ground surface atmospheric pressure. Piston 214 is drivingly connected to rod 220 and rod cup 222. Upper end 222' of rod cup 222 is drivingly connected to springs 210.

Figure 6B:
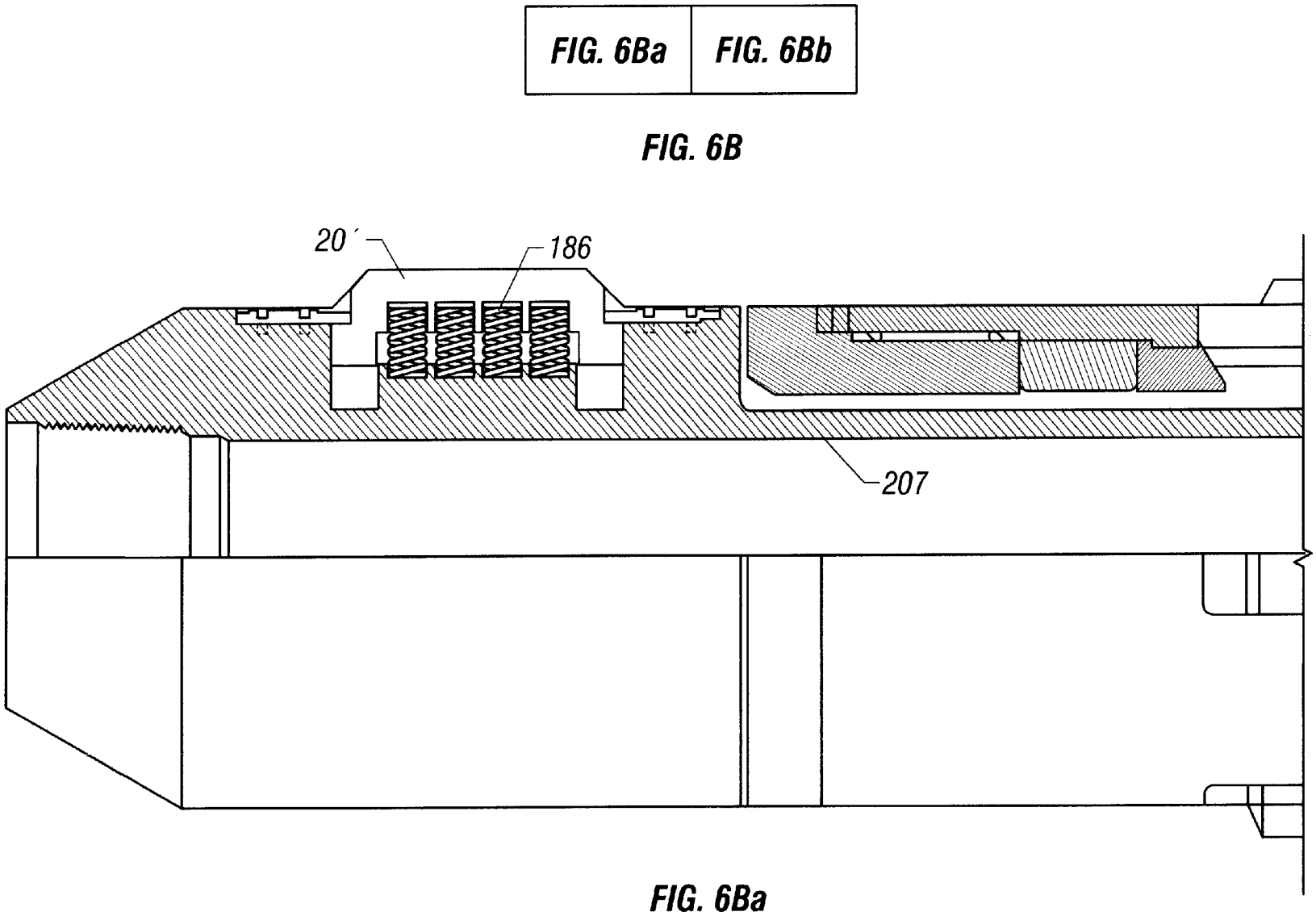
FIG. 6B is a view showing the orientation of FIGS. 6B*a* and 6B*b;*

As the pressure in chamber 216 increases relative to the pressure in chamber 219, piston 214 will be driven to drive rod 220 and rod cup 222 to compress springs 210. It will be readily understood that movement of the rod cup varies the pressure applied to the springs and thereby the pressure at which dogs 208 are biased outwardly from housing 204. Rod cup 222 is preferably limited in travel so as to apply a limited degree of force on springs 210. In particular, in a preferred embodiment, the rod cup travel is required only to preload springs past 400 meters depth. Extra force action on the piston beyond this depth is not transmitted to the springs. Preferably, at maximum compression springs 210 are selected to bias dogs 208 outwardly at a pressure of 20,000 to 30,000 psi and preferably 25,000 psi. The springs can be replaced with other biasing means such as a hydraulic means which is acted upon by the hydrostatic piston. In addition, the assembly can be selected to act on the dogs from both the bottom side and the top side or just from one side, as shown.

Where greater load is required to be applied to the dogs, additional hydrostatic pistons can be added in series.

Where an orienting section is required that does not restrict fluid flow past the tool, a bore can be formed through the tool. Referring to FIG. 6B, an orienting tool is shown including a central bore 207. The tool includes a set of dogs 208' biased outwardly by springs 210'. Springs 210' are acted upon by a torus-shaped piston 215 which has an end 215' open to the hydrostatic pressure in the well and another end open to chamber 219'. The pressure of the fluid in chamber 219' is maintained at atmospheric pressure. A latch 20' is spaced from dogs 208'. Latch 20' is biased outwardly by springs 186.

Figure 7:
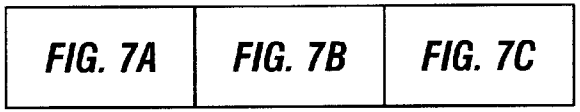
FIG. 7 is a view showing the orientation of FIGS. 7A to 7C.
Figure 7A:
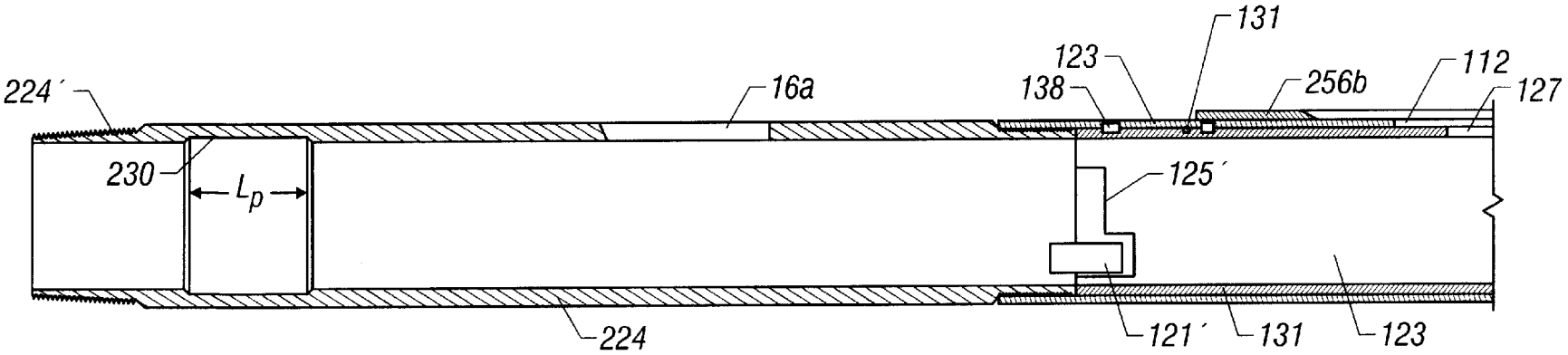
FIGS. 7A to 7C are longitudinal sections along a casing section for a deviated wellbore junction.
Figure 7B:
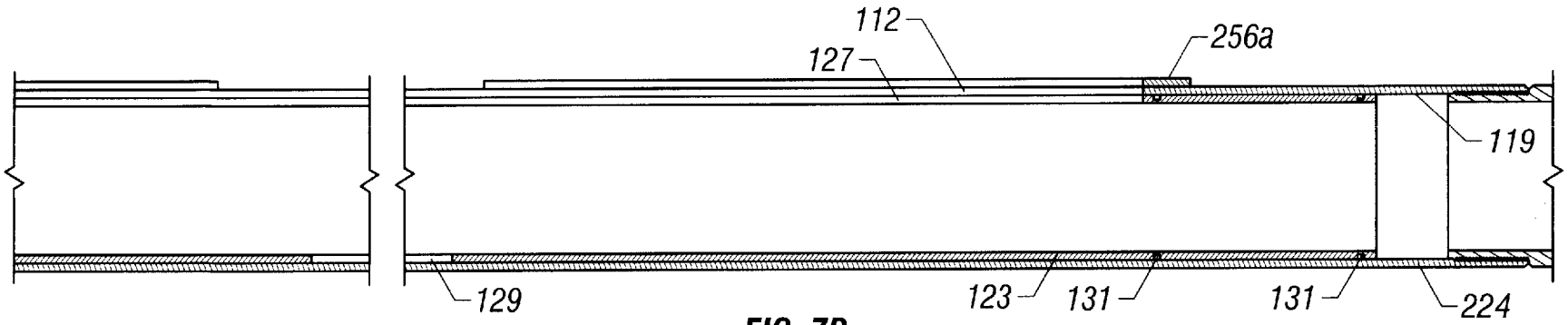
Figure 7C:
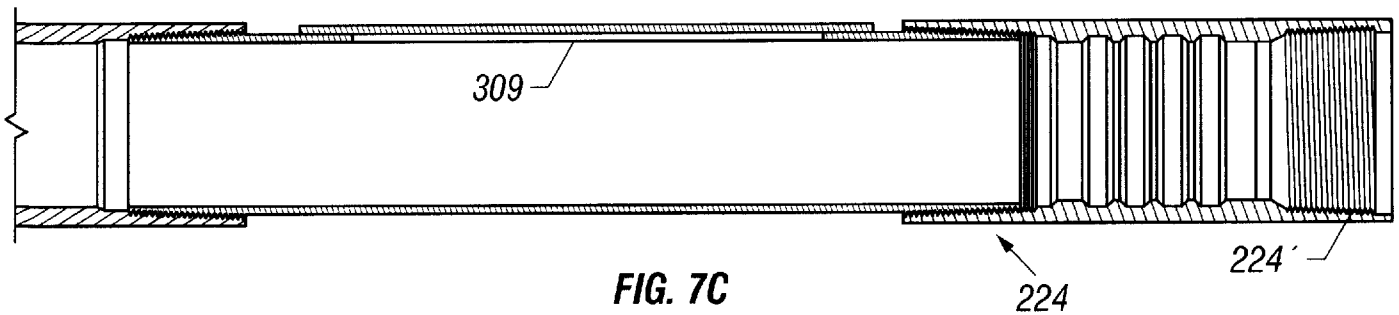

The lower sections of FIGS. 6A and 6B are useful with a casing section 224 as shown in FIGS. 7A to 7C. To fully understand the operation of the lower sections to orient and lock a toolguide into position, we must first review the structure of the casing section. The operation of the lower sections will be described only with reference to the orienting section shown in FIG. 6A, although the operation of the orienting section of FIG. 6B would be similar.

Because of the length of casing section 224, it has been separated into three views. As shown in FIG. 7, FIG. 7A shows the lower portion of the casing section, FIG. 7B shows the middle portion of the casing section and FIG. 7C shows the upper portion of the casing section. For ease of production and handling, the casing section can be produced in separate sections, as shown, for connection together. Alternately, the casing section can be formed as one piece. Casing section 224 is used with other sections, such as those indicated as sections 6 in FIG. 1 to form a casing string. Casing sections 6 can be connected below the section by threaded engagement to pin end 224' in FIG. 7A and casing sections can be connected above casing section 224 by threaded connection to box end 224" in FIG. 7C.

Casing section 224 includes a window opening 112 which is sized and shaped to permit any various assemblies to pass therethrough, such as directional drilling and completion tools. Casing section 224 retains therein a sleeve 123 as will be described hereinafter.

A radial profile 230 is formed at a selected distance below window 112. Radial profile 230 is selected to have a length Lp greater than the axial length Ld of dogs 208 (FIG. 6*b*) so that dogs 208 can be accommodated in profile 230. Casing section 224 also includes a latch receiving slot 16*a* formed a selected distance below and a selected radial orientation from window 112. Preferably, latch receiving slot 16*a* is positioned directly below the window for ease of manufacture. Latch receiving slot 16*a* is selected to be of a size to accommodate the face of latch 20'.

In use a toolguide including lower section 22' and whipstock 24' is run into a casing string including section 224. The lower section is selected such that both the diameter across dogs 208, when they are fully extended, and the diameter of the tool across seals 28, will be greater than the diameter of the casing. Since dogs 208 are biased outwardly, they will engage against the surface of the casing.

A running tool is connected to whipstock and the weight of the tool guide is supported on running tool. At surface, the tool is in the relaxed, unset position (not shown). In particular, the shear pins are inserted through apertures 201 into holes 202 which locks housing 174 down in close position to housing 206 and maintains end 199' in cavity 193 to retain latch 20' in a recessed position. To maintain this configuration during handling, the shear pins at this connection are selected support the weight of the housing 206 and its components. No weight of the whipstock is applied at locking collet 177 and therefore substantially no engagement is made between the locking collet and portion 177*a*. Finally, the pressure in chamber 216 is generally equal to the pressure in chamber 219. Thus, piston is equalized and substantially no pressure is applied at springs 210 of dogs 208. Dogs 208 are therefore biased outwardly a minimum selected pressure, for example, 0 to 500 psi and are capable of being driven inwardly to move into and along the casing string.

As the tool is being run into the casing string, the hydrostatic pressure of the fluids in the well about the tool will increase as the depth of the tool increases. As the pressure of the well fluids increase, the pressure in chamber 216 increases relative to the fixed fluid pressure in chamber 219. This pressure differential causes piston 214 to be driven into chamber 219. Movement of piston 214 is translated to rod 220 which, though rod cup 222, compresses springs 210. Compression of springs 210 drives dogs 208 outwardly at increased pressures until maximum pressure is reached. When maximum pressure is reached the weight of the running string is sufficient to drive the tool through the casing string. However, the pressure biasing the dogs outwardly is selected such that it will affect the load required to move the tool though the casing. In one embodiment, the maximum biasing pressure on dogs 208 is selected to be about 20,000 to 30,000 psi. Preferably, the leading, lower edges 208' of the dogs are sloped to facilitate movement of the dogs over raised or recessed portions of the casing string.

It will be appreciated that, because of the alignment of the dogs about a circumference of the lower section and the pressure acting on the dogs, it will be determinable, by overpull or by a decrease in string weight, when the dogs have passed from the standard casing diameter over or into a profile such as profile 230 in the casing. Preferably, the trailing, upper edge 208" of each dog is selected to be square or only slightly sloped to engage more firmly against raised shoulders in the casing. Thus, to ensure that the dogs are located in profile 230, the toolguide can be pulled up while monitoring the force on the running string to confirm that the dogs have engaged in and against the upper shoulder of the profile.

There can be further radial profiles similar to profile 230 along the casing. The radial profiles are non-selective. Any tool having a set of dogs thereon will pass through each profile and as the dogs pass downwardly through a profile there will be indicative overpull or string weight decrease, depending the direction in which the tool is being moved within the casing. Thus, tool orientation along the length of the casing string can be determined by monitoring the force applied to the running string to determine when the dogs are located in profile 230 and referencing that information to depth information to determine at precisely which profile the tool is located.

The non-selective profiles can be utilized above or below window openings at any known depth in the well. This is useful in positioning a number of various tools relative to a window.

During use of the toolguide in a horizontal section of well, the housing 206 can move laterally, at the connection of rod 199 in bore 204, out of alignment with the remainder of the tool. This prevents the dogs from being compressed by the entire weight of the string.

During confirmation of dog orientation, sufficient pressure will be applied to the string in a upward (toward whipstock) direction, that shear pins in apertures 201 will shear (i.e. at 5,000 psi) and housing 174 will be pulled along rod 199 away from housing 206. This will cause end 199' to be pulled out of cavity 193. The pressure of springs 186 behind latch 20' drives latch 20' outwardly. If latch 20' is biased outwardly to its full extent such that shoulders 191 abut against stops 190, then cavity 193 will then be out of alignment with rod end 199', engagement cannot be made again between latch 20' and rod 199, even where force is again applied toward the lower section. Alternately, if the outward movement, of latch 20' is restricted, as by abutment against a wall of the casing, weight on the tool will drive end 199' back into cavity 193 such that latch 20' will be retracted.

The distance between latch 20' and dogs 208 is selected to be generally equal to the distance between profile 230 and latch receiving slot 16*a* so that when dogs 208 are located in profile 230, latch 20' will be at the same position along the casing as the slot 16*a*. Thus, by rotation of the tool, latch 20' can drop into slot 16*a*. In this configuration sloping face 26' of whipstock 24' will be oriented to direct tools moved along it, laterally outwardly toward window 112.

When the running tool is removed from the whipstock, the weight of the whipstock will be pushed down or set down on the lower section causing tube 179 to force seal 28 to expand outwardly and to cause extensions 198 of mandrel to move into cavity 192 to lock latch 20' in outwardly extended position. Also when the weight of the whipstock is set down on the lower section, locking collet 177 will be driven by its spring to engage against the knurled portion 177*a* of mandrel.

While the embodiment of dogs 208 biased outwardly in response to hydrostatic pressure is preferred, it is to be understood that other assemblies for locating profiles such as collar locators, sleeve shifting tools or collets can be used.

The tools disclosed herein must be run into and retrieved from the well. Running and retrieval tools are known. However, previous running and retrieval tools are sometimes difficult to manipulate and operate. These previous tools are particularly difficult to operate in horizontal runs of casing.

Previous running tools for whipstocks used shear bolts for attachment between the running tool and the whipstock. These shear bolts are prone to shearing prematurely if the whipstock is bumped at surface while entering the will or sue to running the assembly through a tight area in the casing. The shear bolt may also shear prematurely if the assembly is rotated.

A new tool 270 which can be used for both run in and retrieval of whipstocks is shown in FIG. 8. Tool 270 is intended for use with a whipstock as shown in FIGS. 4A and 4B and a casing section as shown in FIGS. 7A to 7C. To facilitate understanding of the tool 270 reference should be made to those Figures.

Tool 270 is positively latched to the whipstock in a manner that allows forces to be applied upwardly or downwardly as well as rotationally without risk of prematurely releasing the whipstock. At the desired time of release, hydraulic pressure is applied to the tool to unlatch it from the whipstock.

Tool 270 includes a front end 270' and a threaded end 270" for connection to a drill pipe, such as that shown as 32 in FIG. 1. A bore 272 extends a portion of the length of the tool and opens at end 270". A piston 274 is disposed to move slidably along a length of bore between shoulders 276, 277 and a spring 280 is disposed between piston 274 and an end wall 284 of bore 272 to bias the piston outwardly against shoulder 276. A rod 286 is connected to piston 274 and is driven thereby. Rod 286 is extends through a channel 287 extending from bore 272 and has a tapered end 286'. Preferably, rod 286 is bifurcated to form two arms, each with a tapered end.

Tool 270 houses a latch assembly including a latch 288, a latch retaining plate 290 and a plurality of springs 292 acting between the latch 288 and the plate 290 to bias the latch radially outwardly from the tool. Of course, the plate can be replaced with an end wall formed integral with the body of the tool. However, a plate is preferred for ease of manufacture. Latch 288 is retained in a channel 294 through tool 270. Latch 288 can be recessed into channel 294 by application of force sufficient to overcome the tension in springs 292 on the latch toward plate 290. Latch 288 is prevented from being forced by the action of springs 292 out of the channel, by abutting against end 286' of rod 286 which extends into channel. In particular, latch 288 has a ramped surface 296 over which tapered end 286' can ride.

Movement of rod 286 through channel 287, by movement of piston, causes latch 288 to be moved radially inward and outward in tool, by movement of tapered end 286' over ramped surface 296. Thus, by controlling the pressure acting on piston face 274', latch 288 can be selectively moved.

Latch 288 is formed to fit into a slot, such as slot 55 on whipstock 24' of FIG. 4A. Latch has a ramped surface 300 on its front edge, to ease the movement of the latch over protrusions. A reverse angle portion 302 is provided on the rear edge of the latch which acts as a catch to resist against the latch moving out of the slot by any force applied toward end 270".

Tool 270 further includes an orienting key 304 retained in cavity 305. Key 304 is biased radially outwardly from the tool by means of springs 306 acting between the key and an end wall 305*a* of cavity 305. Key 304 is prevented from being forced out of cavity 305 by shoulders 308. Key 304 is selected to fit into an orienting slot on a casing section, such as slot 309 in casing section 224.

Tool 270 has formed thereon a dove-tailed rail 310. Rail 310 is selected to fit into a dove-tail slot on a whipstock, such as that indicated as slot 51 in FIG. 4A. Rail 310 is oriented relative to latch 288 with consideration as to the orientation of slots 51 and 55 on the whipstock with which the tool is to be used. Rail 310 is spaced from latch 288 a selected distance which corresponds to the distance between slot 55 and 51 on the whipstock. Preferably, rail 310 is formed to be in longitudinal alignment with latch 288. Rail 310 is oriented on the tool relative to key 304, with consideration as to the orientation which slot 309 has relative to a slot 51, when a whipstock is mounted in the casing section. In the illustrated embodiment, slot 309 is longitudinally aligned with window. Thus, when a whipstock is mounted in the casing section, the sloping face of the whipstock will be positioned opposite the window and slot 309 and in the illustrated embodiment rail 310 is spaced 180 degrees from key 304.

Another key 312 is preferably provided on the tool and spaced 180 degrees from rail 310. Key 312 rides in a port 314 opening between the outer surface of the tool and bore 272. Key 312 can be moved along a portion of the port 314 as limited by shoulders 316*a*, 316*b*.

Tool 270 preferably includes a first fluid delivery port 318 extending between bore 272 and an end 310' of rail 310. A second fluid delivery port 320 extends between bore 272 and a position adjacent latch 288.

In use in a running operation, tool 270 is attached to whipstock 24' at surface. This is done by advancing the tool toward the whipstock so that rail 310 is inserted into slot 51. This requires that latch 288 be forced into channel 294 by any suitable means. When rail 310 is fully inserted in slot 51, latch 288 will engage in slot 55. A drill pipe is attached at end 270". Latch 288 is maintained in slot by action of springs 292.

Tool 270, with whipstock 24' attached, is then run into the well on the drill pipe. When whipstock is properly mounted in the casing, whipstock 24' is released tool 270 by applying pressure against the piston to drive rod 286 through channel 287 to, thereby, drive latch 288 into a recessed position in the tool. Pressure can be applied to the piston, for example, by forcing a drilling fluid, such as mud, through the drill pipe into bore 272. Application of drilling fluid increases the pressure in the bore and drives piston 274 against spring 280, which in turn drives rod 286 to advance against latch 288.

When latch 288 is removed from slot 55, rail 310 can be removed from slot 51. Tool 270 is then free to be returned to surface.

To use tool 270 in a retrieval operation, the tool is run in on a drill pipe until it runs into the whipstock. The tool is then pulled out a short distance and is rotated until key 304 drops into slot 309. Because the orientation of slot 309 with respect to a whipstock mounted in the casing section is selected to correspond to the location of key 304 with respect to rail 310, the rail will be aligned with slot 51 of the whipstock when key 304 is engaged in its slot 309.

Pressure is then applied to piston, such as by pressuring up the drill string, to retract latch 288 so that the tool can thus be advanced to insert rail 310 in slot 51. Applying fluids to bore 272 also serves to cause fluid to be passed through and out ports 318 and 320 at high pressures to clean out slots 51 and 55 which may be filled with debris. Pressure in bore 272 also acts against key 312 to cause it to be driven radially outwardly from the tool. This causes the rail to be driven toward the casing wall. Key 312 is particularly useful when the tool is used in horizontal runs of casing. In horizontal wells, the whipstock is sometimes mounted against the upper side of the casing, as determined by gravity. When the tool is used to latch onto the whipstock, the weight of the tool and drill pipe will cause key 304 to be driven into cavity 305. Thus, rail is out of position for insertion into slot and will simply ride under the sloping face of the whipstock. Key 312 can then be used to raise the tool toward the upper side of the well casing so that rail 310 can align with slot 51.

When rail 310 is inserted fully into slot 51, the drill pipe can be depressurized to permit the latch to be biased outwardly into slot 55. Tool 270, with whipstock 24', attached can then be retrieved back to surface.

When rail 310 and latch 288 are engaged in their respective slots on the whipstock, all forces, either longitudinal or torsional, which are applied to the tool are directly transmitted to the whipstock. Tool 270 permits both run in and retrieval and is useful in horizontal well sections.

Figure 9:
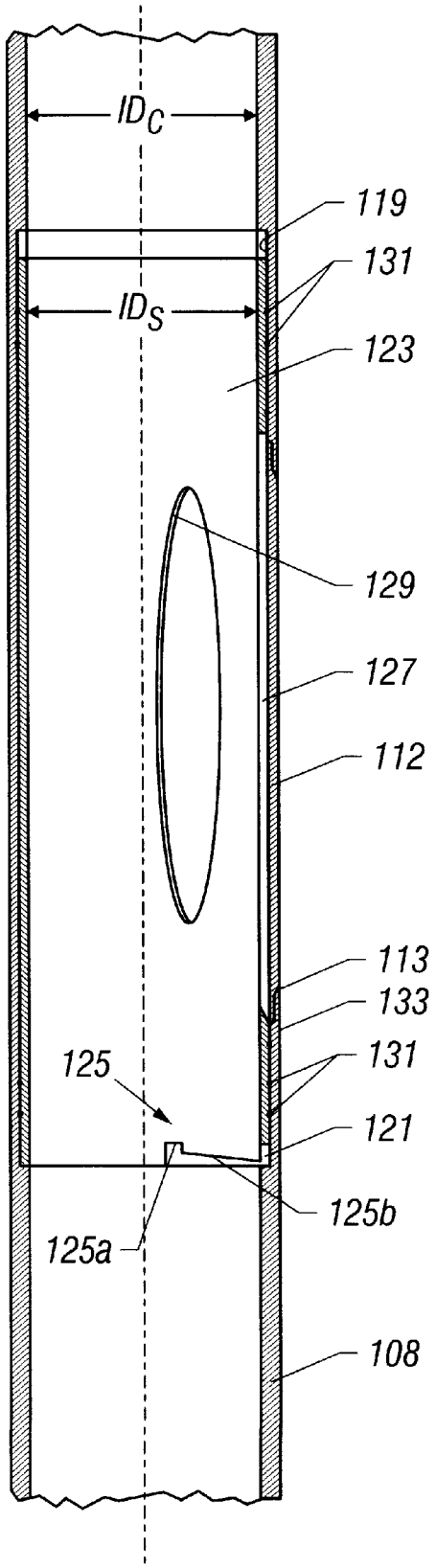
FIG. 9 is a longitudinal section along another casing section for a deviated wellbore junction according to the present invention.

Referring to FIG. 9, another casing section 108 is shown. Casing section 108 is useful in the drilling and completion of deviated well bores. It is used attached to other casing sections such as those indicated as sections 6 in FIG. 1 to form a casing string.

Casing section 108 includes a window opening 112 and a sleeve 123. Casing section 108 has a known internal diameter, indicated at IDc. Casing section 108 is formed or assembled in such a way as to allow the placement of a sleeve 123 internally. In particular, a cylindrical groove 119 is formed in the inner surface of the casing. Groove 119 has a larger inner diameter than the casing such that, when the sleeve is disposed therein, the sleeve and the casing on either side of the sleeve have the same ID. A key 121 is secured, as by welding, in the groove adjacent its bottom edge.

Sleeve 123 is disposed in groove 119. An embodiment of the sleeve for use in the embodiment of FIG. 9 is shown in flattened configuration in FIG. 10. To ready the sleeve shown in FIG. 10 for use, sides 123*a*, 123*b* of the sleeve are brought together and preferably attached, as by welding.

Sleeve 123 has a key slot 125 at its lower edge to engage key 121. Key slot 125 has two locking slots 125*a* and 125*a*$^1$ and a ramped portion 125*b* therebetween to facilitate movement of key 121 between slots 125*a*, 125*a*$^1$. Sleeve 123 is rotatable and longitudinally moveable in groove 119 and key slot 125 is formed to limit the movement of sleeve 123 over key 121 between a first position at locking slot 125a and a second position at locking slot 125*a*$^1$. Sleeve 123 is selected to have an inner diameter IDs which is greater than or equal to the inner diameter lDc of casing 108.

Sleeve 123 has a first opening 127 which is larger than window opening 112 but is positioned on the sleeve such that it can be aligned over window opening 112. Sleeve 123 preferably also has a second opening 129 which is substantially equal to or smaller than window opening 112. Second opening 129 is shown spaced about 180 degrees from opening 127 in FIGS. 7A to 7C, while in FIG. 9 opening 129 is rotated only about 80 degrees from first opening 127. Second opening 129 is also positioned on sleeve 123 such that it can be aligned over window opening 112. Key slot 125 is shaped relative to key 121 to permit movement of the sleeve to align one of the first and second openings 127, 129 over window opening 112 and locking slots 125*a*, 125*a*$^1$ are positioned to lock the sleeve by its weight at these aligned positions.

Figure 10:
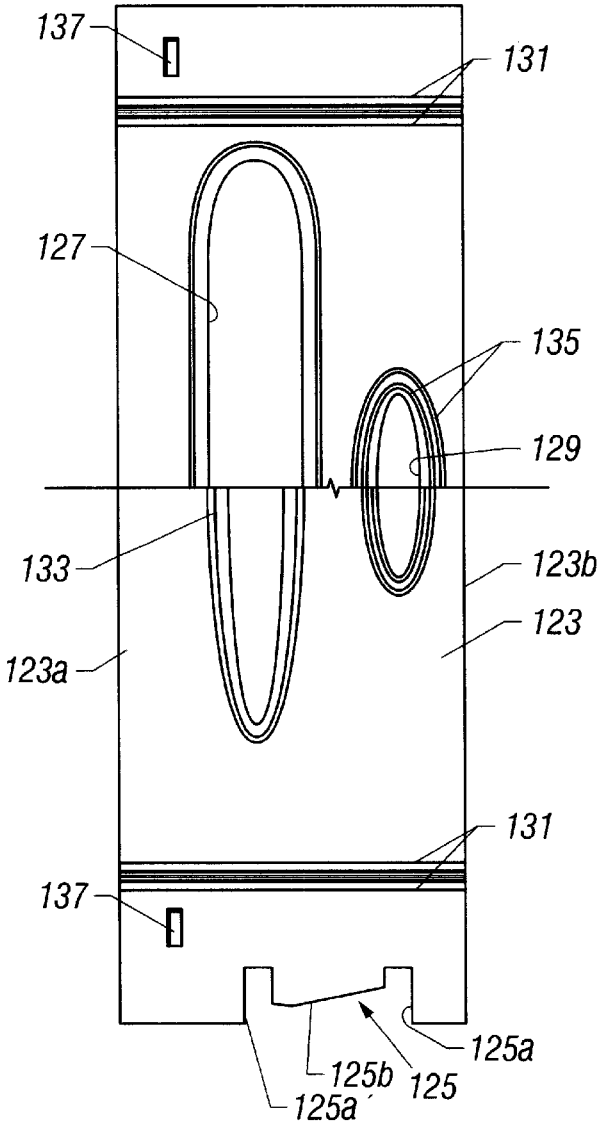
FIG. 10 is a rear plan view of a sleeve according to the present invention in flattened configuration.

Seals 131 are provided at the upper and lower limits of the sleeve between the sleeve and groove 119. In the embodiment of FIG. 10, seals 133, 135 are also provided about openings 127 and 129, respectively. Seals 131, 133, 135 are each formed of materials which are hydraulically sealing such as o-rings positioned in retaining grooves or lines of vulcanized polymers such as urethane. Preferably, the seating areas for the seals are treated, for example by machining to provide a smooth surface, to enhance the sealing properties of the seals. The seals act against the passage of fluids between the sleeve and the structure to which they are seated, for example the casing or the flange of a tieback hanger. In an alternate embodiment, the seals are secured to the casing and the sleeve rides over them.

In the embodiment of FIG. 10, an aperture 137 is provided on the sleeve which is sized to accept, and engage releasably latches on a shifting tool (not shown). The latches of the shifting tool hook into apertures 137 on sleeve 123 and shift tool is raised to pull the sleeve upwardly to release key 121 from locking slot 125*a* or 125*a*$^1$ into which the key is locked. The shifting tool then rotates sleeve 123 within groove 119.

The sleeve can be shifted by other means such as a sleeve shifting tool, as will be described in more detail hereinafter, having pads with teeth formed thereon for being forced against the sleeve material so that the sleeve can be rotated in the groove.

Figure 11A:
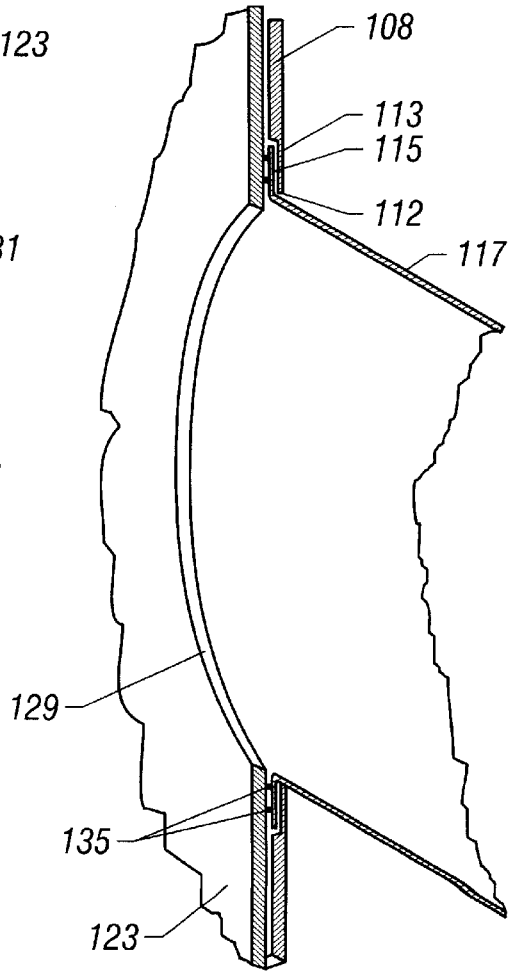
FIG. 11A is a sectional view through a deviated wellbore junction using a casing section according to the present invention.

Window opening 112 has a profiled edge 113. Edge 113 is formed to accommodate and retain a flange 115 (FIG. 11A) formed on a deviated wellbore liner or tieback hanger 117.

In use, casing section 108 having sleeve 123 disposed therein is prepared for placement downhole by aligning opening 127 over window 112. To prevent inadvertent rotation of sleeve 123 in its groove, shear pins (not shown) are inserted to act between the sleeve and the casing section. A liner is then inserted through the internal diameter and opening 112 is filled and wrapped, as discussed with respect to FIG. 2. A casing string is formed by attaching casing section 108 to other casing sections selected from those which have window openings or those which are standard casing sections. The casing string is then inserted into the wellbore and is aligned, as desired. The wellbore is then completed.

After completion, the hardened cement and the liner are removed from the casing string. This exposes sleeve 123 within casing section 108. A toolguide, for example, according to FIG. 1 or any other toolguide, is positioned in the well such that the ace of its whipstock is opposite opening 112 and a deviated wellbore is drilled.

Once the deviated wellbore is drilled, at least a junction fitting such as a tieback hanger 117 is run into the well and positioned such that its flange 115 is engaged on edge 113. Sleeve 123 is then lifted and rotated by engaging the setting tool in apertures 137 such that opening 129 is aligned over opening 112 and thereby the central opening of the tieback hanger. This causes seals 135 to seal against flange 115 and prevents fluids from outside the deviated casing from entering into casing section 108 at the junction. Using the sleeve of the present invention, the deviated wellbore does not need to be completed using cement to seal against passage of fluids outside the casing. However, where desired, the deviated wellbore can be completed using cement to increase the pressure rating of the seal.

Figures 16A, 16B:
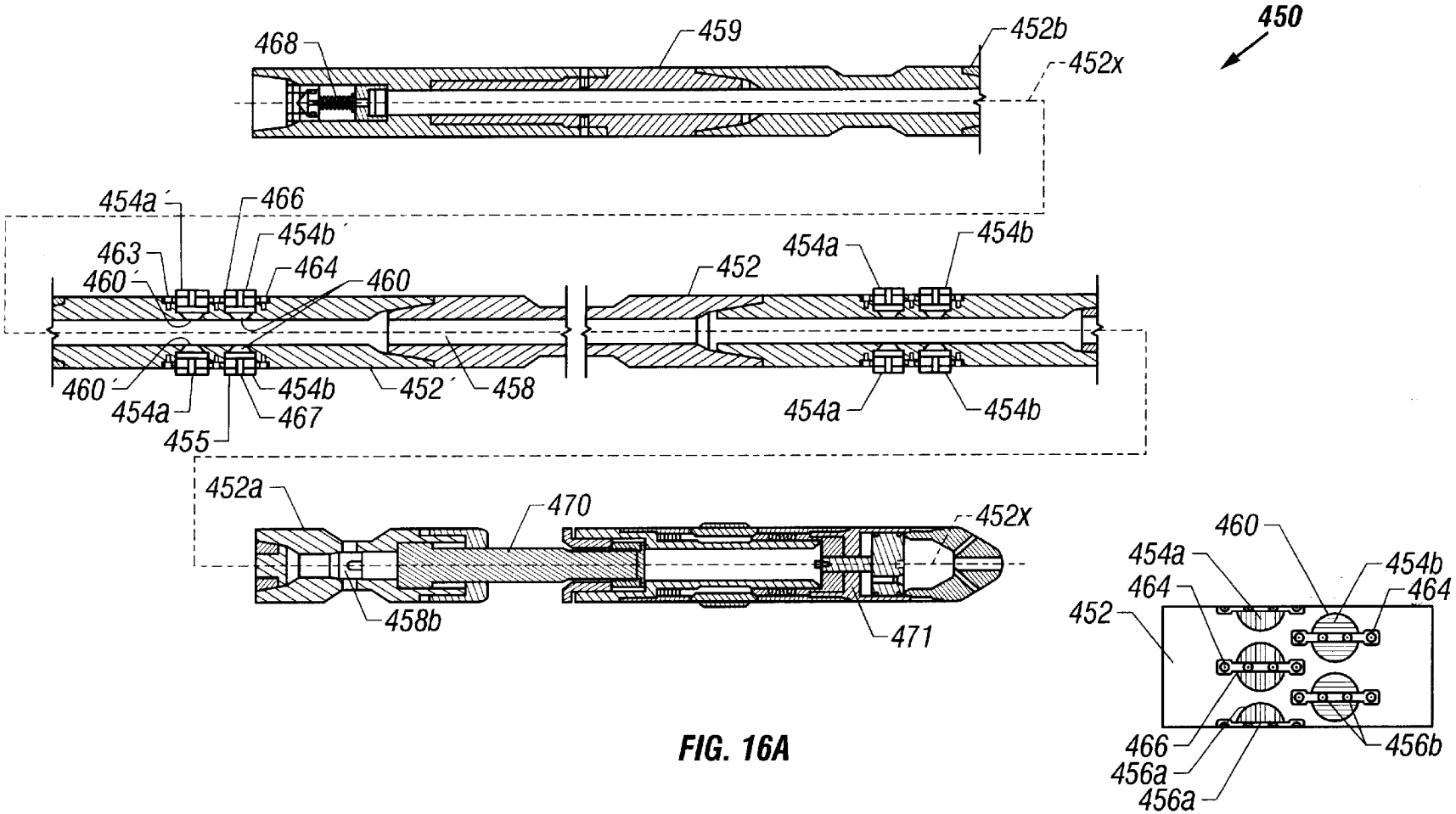
FIG. 16A is a longitudinal sectional view along a sleeve shifting tool according to the present invention.
FIG. 16B is front elevation view of a portion of the sleeve shifting tool of FIG. 16A showing the sleeve engaging slips.

The sleeves according to the present invention can be rotated using any suitable tool. A tool which engages in apertures 137 can be used or alternately a sleeve shifting tool 450 can be used as shown in FIGS. 16A and 16B which does not require the alignment of dogs into apertures but rather frictionally engages the sleeve. In particular, tool 450 is sized to be insertable into the inner bore of the casing and sleeve and includes an elongate body 452. A plurality of sleeve engaging slips 454*a*, 454*b* are mounted in the body to be moveable radially inwardly and outwardly between a retracted position (i.e. 454*a*') and an extended position (i.e. 454*b*'). In the extended position, the slips 454*a*, 454*b* are selected to frictionally engage against the sleeve with sufficient force to permit lifting and rotating of the sleeve.

Preferably, the sleeve engaging slips are selectively positioned along the tool so that they will engage the sleeve adjacent the upper and lower edges thereof and at a plurality of positions about the inner radius. The sleeve engaging slips can be formed in any suitable way to engage against the sleeve. In one embodiment, the sleeve engaging faces 455 of the slips are roughened or knurled or have teeth formed thereon in a suitable way to permit the slips to bite into the material of the sleeve. In the illustrated embodiment, slips are provided in two orientations. Slips 454*a* are selected to enhance frictional engagement to provide for longitudinal movement (ie. lifting) of the sleeve and slips 454*b* are selected to enhance frictional engagement to provide for rotational movement of the sleeve. In particular, slips 454*a* include elongate teeth 456*a* formed orthogonal to the long axis 452*x* of the body 452 and slips 454*b* include elongate teeth 456*b* formed substantially parallel to long axis 452*x*. Preferably the teeth 456*a*, 456*b* are formed with leading edges formed to define acute angle so that they exhibit enhanced frictional engagement in one direction.

Sleeve engaging slips 454*a*, 454*b* can be moved radially inwardly and outwardly between the retracted position and the extended position in any suitable way. In the illustrated embodiment, the slips 454*a*, 454*b* are moveable by changes in fluid pressure as controlled from surface. In particular, body 452 is formed as a tube having an inner bore 458 closed at one end 452*a* by a plug 458*b*. Body 452 is connected at opposite end 452*b* to a tubing string 459 extending upwardly toward surface such that bore 458 can be pressured up by feeding a fluid from surface through tubing string 459.

Slips 454*a*, 454*b* are mounted in ports 460 to be radially slidable therein relative to the long axis of the tool. The outer diameter of the slips conform closely to the inner diameter of the ports so that resistance is provided to fluids passing therebetween. O-rings 463 are provided about the slips to form a seal between ports 460 and slips 454*a*, 454*b*. Ports 460 open into bore 458 to be in communication therewith and open to the outer surface 452' of body 452. Ports 460 have a reduced diameter at portion 460' to prevent slips 454*a*, 454*b* from dropping into bore 458 and straps 464 are mounted, as by use of fasteners or weldments, across ports adjacent outer surface 452' to hold the slips in the ports. Slips 454*a*, 454*b* each include a slot 466 extending across the engaging face thereof to accept strap 464. Slot 466 permits the engaging face of the pad to extend out beyond strap. As will be appreciated, strap 464 also prevents the rotation of the slips within the ports, thereby preventing the teeth from rotating out of their selected orientation. Springs 467 are provided between the straps and the slot 466 to bias the slips inwardly. Preferably, straps 464 are not intended to hold the slips in the ports against fluid pressure behind the slips. Instead, the tool is intended only to be pressurized while within a member such as the casing which prevents the slips from extending to bear against the straps.

Although FIG. 16B appears to show that a plurality of slips are positioned in close proximity about the tool, preferably there are two to four slips 454*a* positioned at each of the top and the bottom of the tool. In each position, these slips are equally spaced apart around the circumference. The same arrangement is selected for the slips 454*b*.

As noted above, the slips 454*a*, 454*b* are moveable by changes in fluid pressure in bore. In use, when the pressure of the fluid in bore 458 is increased relative to the pressure about the tool, slips 454*a*, 454*b* are driven outwardly through ports 460 against the tension in springs 467 and into extended position until the slips engage against the sleeve. If a sufficiently high pressure is provided to the bore, the slips will bite into the sleeve with a frictional engagement sufficient to move the sleeve by movement of the tool, as by movement from surface. If the pressure is maintained, the slips will remain in the extended position. If the pressure is lowered, to a pressure relatively equal to or less than the ambient pressure around the tool, the slips will be retractable and will not maintain a frictional engagement with sleeve which is sufficient to move the sleeve by movement of the tool.

To assist in the pressurization of the bore, a check valve 468 is provided adjacent end 452*b*, either in the bore of the tubing string 459, as shown, or in bore 458 of body 452 above the upper set of slips. Check valve 468 permits the flow of fluid behind slips 454*a*, 454*b*, but substantially prevents fluid from passing upwardly out of bore 458. Thus, pressure can be maintained behind the slips to maintain them in an extended position without maintaining the pressure in the entire tubing string to surface. When check valve 468 is used, a means for releasing the pressure from within the bore is required in order to permit the tool to be disengaged from the sleeve, once the sleeve has been shifted. As an example, valve 468 can be mechanically or electrically openable or a vent can be provided. In the illustrated embodiment, plug 458*b* is burstable by application of pressure greater than a selected value. Therefore, when it is desirable to release the tool from engagement with the sleeve, further fluid pressure is forced into bore 458 through check valve 468 until plug 458*b* bursts allowing equalization between the bore pressure and the pressure about the tool.

Figure 6B:
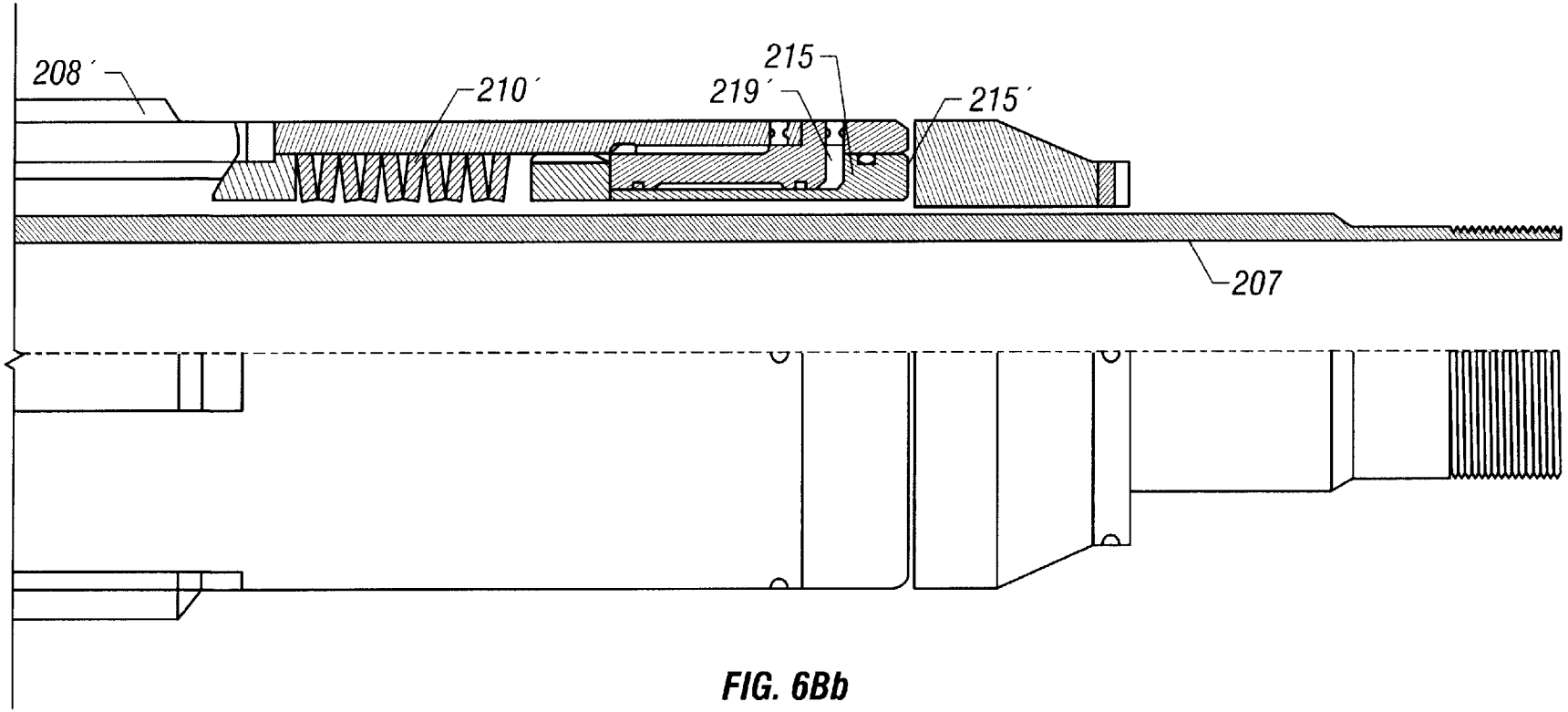

To permit proper positioning of the tool at the location of the sleeve in the well bore, a wobble shaft arrangement 470 and an orienting assembly 471, as discussed hereinabove with respect to FIG. 6, can be used.

Figure 12:
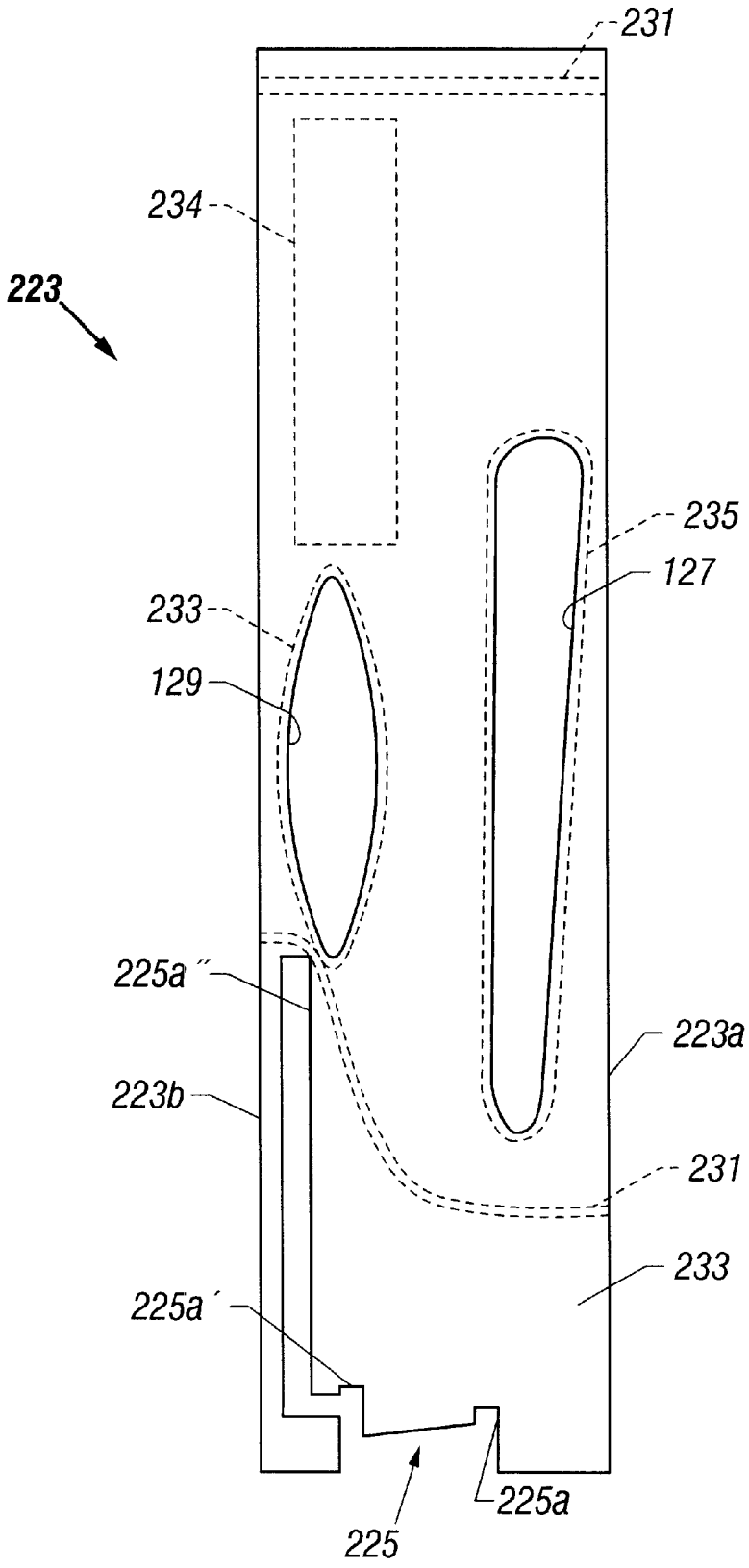
FIG. 12 is a front elevation view of another sleeve according to the present invention in flattened configuration.

The sleeve according to the present invention can be modified to permit other uses. For example, a sleeve can be used which has one or two openings. One of the openings of the sleeve can be aligned with a casing window opening, while the sleeve can be repositioned such that a solid portion of the sleeve blocks the window opening. Referring to FIG. 12, sleeve 223 is shown in flattened configuration and when readied for insertion into a groove of a casing section sides 223*a*, 223*b* are brought together. A key slot 225 is formed at the lower edge of sleeve 223 for riding over a key formed in the groove of the casing section in which the sleeve is to be used. Key slot 225 has three locking slots 225*a*, 225*a*' and 225*a*" to permit sleeve 223 to be moved between three positions. The first position of which is where the key is locked, by the weight of the sleeve, into slot 225*a* and opening 127 is aligned with the window opening of the casing section. The second position is that in which the key is locked into slot 225*a*' and opening 129 is disposed over the casing window opening. The third position is the one in which the key is locked into slot 225*a*" and a solid portion of the sleeve indicated in phantom at 234, is disposed to block off the window opening of the casing section. The sleeve can be moved between any of these positions by a shifting tool. The groove into which the sleeve is mounted is formed to accommodate such movement.

Seals 233, 235 are provided around openings 127, 129 and seals 231 are provided around the upper and lower regions of sleeve 223 to hydraulically seal between the sleeve and the casing into which the sleeve is mounted. The seals are on the other side of the sleeve and are shown in phantom in this view.

Figure 11B:
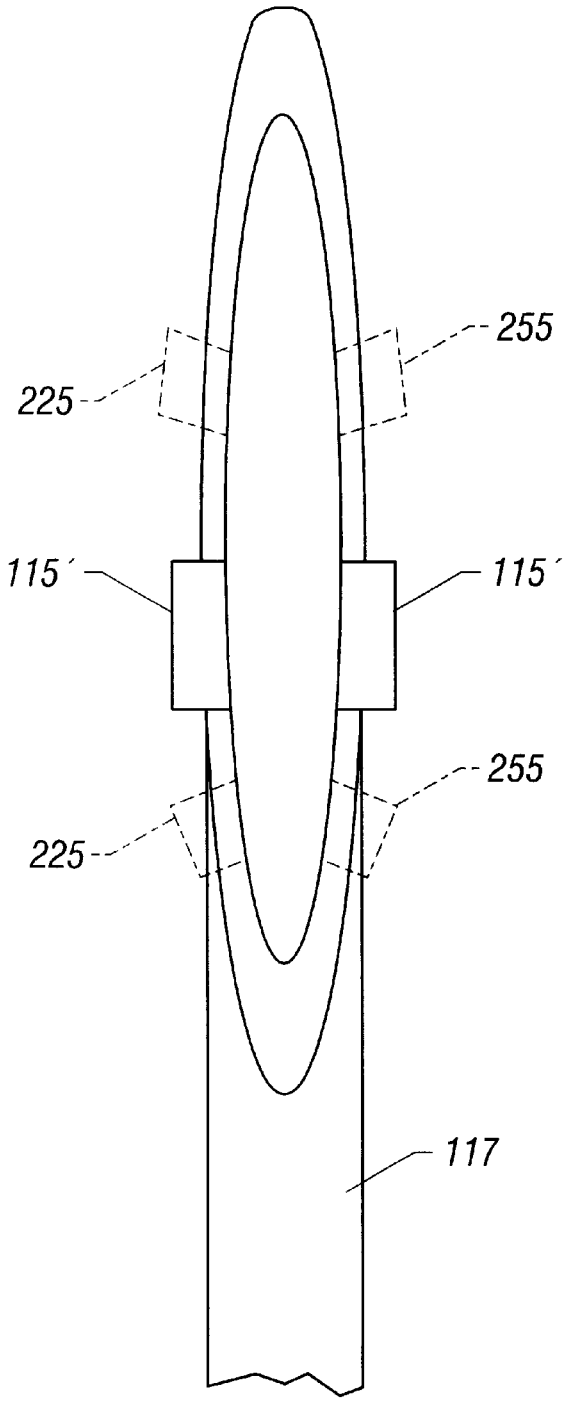
FIG. 11B is a front elevation view of a tieback hanger.

Referring to FIG. 11B, generally the tieback flanges are formed as tabs 115' and are disposed on the tieback 117 to extend out from the sides thereof. There can be two tabs 115', as shown, or four tabs 255 shown in phantom. Because of the arrangement of the tabs and the way in which they extend out from the sides of the tie back, it has been difficult or impossible to use a liner having an outer diameter just less than the inner diameter of the casing through which it is to be run. In particular, in such an arrangement, the casing window is so large across its width that the flange tabs have nothing to latch against.

Figure 11C:
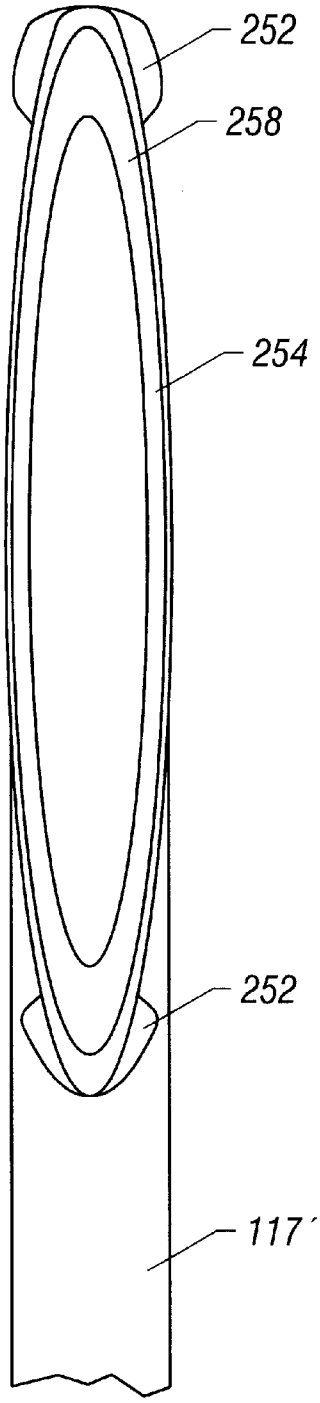
FIG. 11C is a front elevation view of a tieback hanger.

Referring to FIG. 11C, a tieback hanger 117' has been invented which is useful for use in tying back a liner having an outer diameter close to that of the casing inner diameter. Tieback hanger 117' has flanges 252 positioned at the top and bottom of its open face 254.

Figure 13:
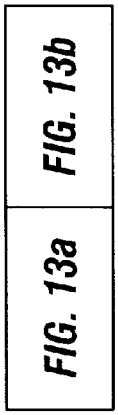
FIG. 13 is a view showing the orientation of FIGS. 13*a* and 13*b;*
Figure 13A:
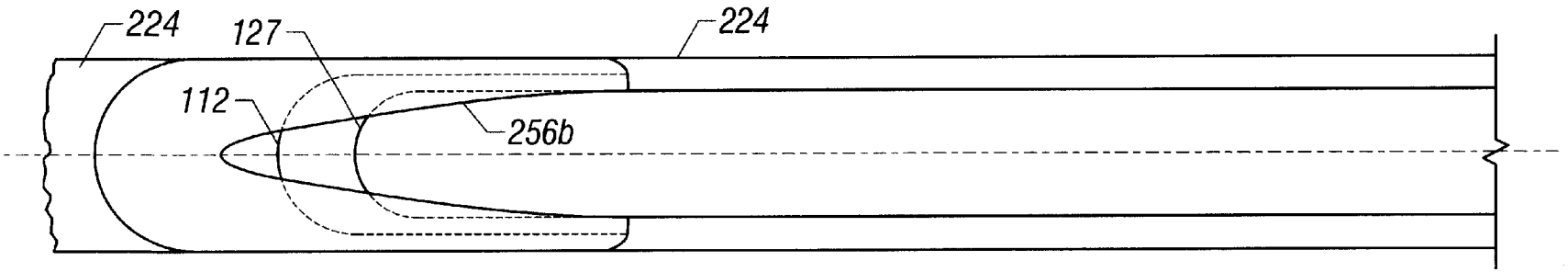
FIGS. 13*a* and 13*b* are elevation views of a casing section including a window opening.
Figure 13B:
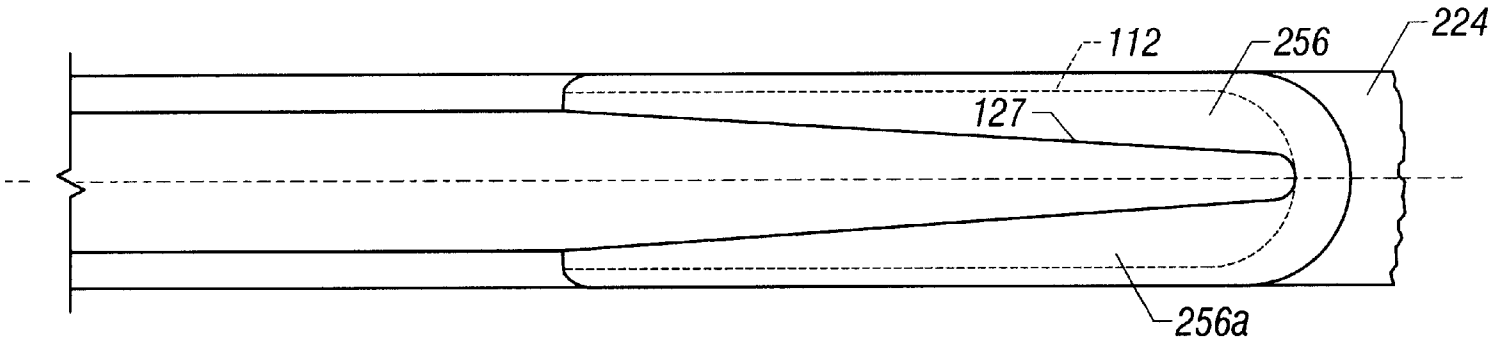

Tieback hanger 117' is intended to be used with a casing section, such as that shown in FIGS. 7A to 7C and in FIG. 13. The casing section includes a wall 256*a* extending out into window 112 adjacent the top thereof and another wall 256*b* extending out at the bottom of the window. Walls 256*a*, 256*b* provide surfaces against which flanges 252 can latch. Walls 256*a*, 256*b* are recessed relative to the inner surface of casing section 224, so that when flanges 252 latch against the walls, sleeve 123 can be rotated over the open face 254 of the tieback hanger to hydraulically seal off the liner. In this embodiment, preferably, the open face 254 of the tieback hanger has bonded thereto, as by vulcanization, a polymeric material 258 such as, for example, urethane to seal against the sleeve.

Walls 256*a*, 256*b* can be partial or complete. Preferably the walls are disposed at the top and bottom of the window and form a V-shaped opening. The walls can be formed integral with the casing section 224 or can be attached, as by welding, to the outside of the casing section.

To facilitate use of the tools and the casing sections described herein and others not herein described, preferably a high side tool is used. To facilitate use of the high side tool, preferably sensors such as, for example, magnetic sensors, are mounted in the tools and/or the casing section components (ie. the sleeve), for reading by the high side tool. The sensors are preferably mounted so that it can be determined both (a) where the high side, according to gravity, is and (b) the degree to which any well component has been rotated.

Another problem which occurs in downhole assembly manipulation is the orientation of the tieback hanger in proper position for insertion through the window. Previous tools actuate the tieback hanger and liner too slowly and therefore increase the chances of the liner being stuck against a negative pressure formation.

Figure 14:
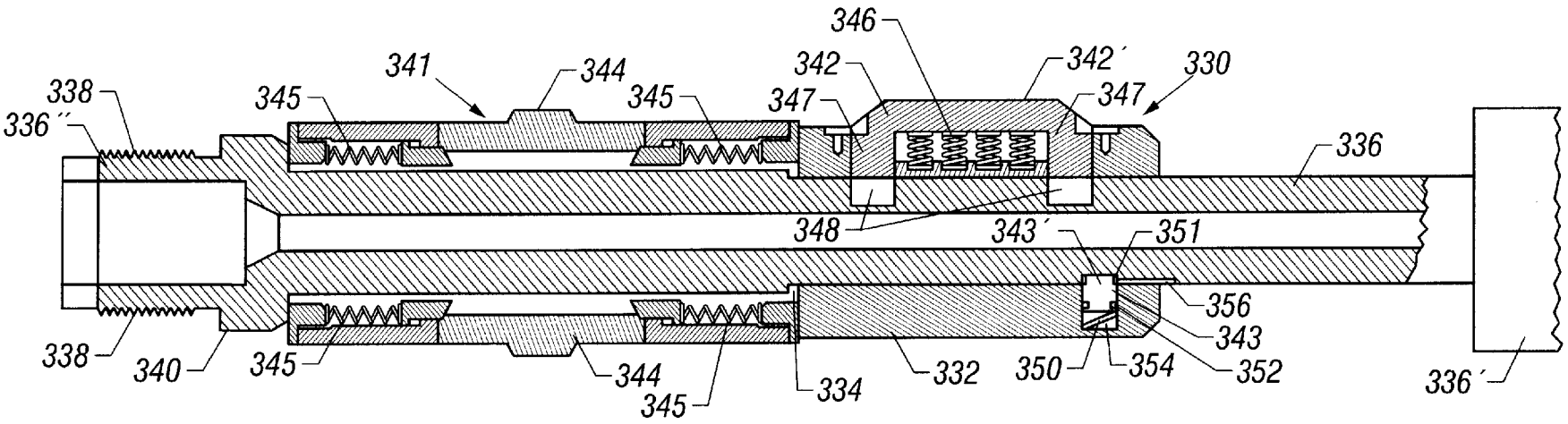
FIG. 14 is a longitudinal sectional view along a liner positioning tool.

Referring to FIG. 14, a tool 330 has been invented which useful for downhole placement and positioning of tieback hangers. Tool 330 includes a housing 332 with a bore 334 extending therethrough. Slidably positioned in bore 334 is a rod 336. Rod 336 and bore 334 are similarly faceted at least along a portion of their lengths so that rod 336 is substantially prevented from rotating in the bore. Rod 336 has a box end 336' for connection to a drill pipe (not shown). Box end 336' acts to limit the sliding movement of rod 336 through bore 334 by abutment against housing 332.

At its opposite end 336", the rod has formed thereon threads 338 for connection to a flex shaft which extends into a whipstock and bends along the face thereof for connection to a hydraulic liner running and setting tool, as are known (not shown). A shoulder 340 is formed to abut against the end of the flex shaft, when the flex shaft is engaged on the rod.

Housing supports a collet 341, a key 342 and a poppet 343. Collet 341 includes a plurality of (ie. four) circumferentially aligned dogs 344. Dogs 344 are biased radially outwardly by springs 345 and are selected to locate in a profile formed in a casing section (not shown) for use with the tool. Preferably, the profile is a radial groove to avoid having to properly orient the dogs to drop into the profile and to thereby ease location of dogs 344 therein. Operation of dogs 344 is similar to the operation of dogs 208 of FIG. 6A.

Key 342 is biased radially outwardly from housing by springs 346 but is secured in the housing by walls 348. Rearwardly extending arms 347 extend from key 342 into bore. Cavities 348 are formed in rod 336 to accept arms 347, when they are aligned. When key 342 is recessed into cavities, rod 336 is prevented from sliding movement through bore 334. The diameter of the tool at key 342, when the key is fully extended is selected to be greater than the diameter of the casing in which the tool is to be used. This provides that when the tool is located in the casing, the key will be forced against the tension in springs 346 into the housing. Key 342 has chamfered ends 342' to facilitate riding over protrusions. The sides of key 342 (which cannot be seen) have substantially no chamfer to be square or to form a reverse angle so that they will tend to catch on protrusions in the casing. The key is formed to fit into an orienting slot on the casing section in which it is to be used. When whipstock is connected through the flex shaft to tool 330, the whipstock face is positioned in a selected orientation relative to key 342. The selected orientation will depend on the orientation of the slot for key 342 relative to the window opening in the casing.

Poppet 343 is positioned in a hole 349 opening into bore 334 and is biased into the bore by a spring 350. A cavity 351 is formed on shaft 336 for accepting head 343' of the poppet, when the head and the cavity are aligned. When poppet 343 is positioned in cavity 351, shaft 336 is prevented from sliding movement within bore 334. A seal 352 disposed about poppet 343 forms a chamber 354. The pressure in chamber 354 is selected to be a level near surface pressure. A port 356 extends from the exterior of the tool either along shaft 336, as shown, or along housing to open adjacent head 343'.

Tool is used to rapidly position a tieback hanger for proper placement in the window to affect latching of the tieback flange against the window. In use, at surface tool is connected at end 336" to a flex shaft which has attached thereto a tieback hanger and a hydraulic liner running tool. Housing 332 is moved along rod 336 until poppet 343 snaps into cavity 351. A drill pipe (not shown) is attached at end 336' and the tool with attachments is inserted into the well.

In the casing, dogs 344 ride along the inner surface of the casing and key 342 is driven inwardly so that arms 347 engage in cavities 348. As the tool run further into the well, the hydrostatic pressure in the well will be communicated to head 343' of the poppet through port 356. As the hydrostatic pressure increases, poppet will be driven back into chamber 354 and out of engagement with rod 336. This will release the full weight of the rod and attachments onto key 342. Rod will remain in fixed position relative to housing, however, because of arms 347.

The tool is run to a depth such that dogs 344 drop into their profile in the casing. When the dogs are located in their profile, the key will be positioned at the appropriate level to engage in its slot and the tool need only be rotated to locate key 342 in its slot. When key 342 locates in its slot, springs 346 drive arms 347 out of cavities 348 and rod 336 will immediately slide through bore 334 in response to the weight of the attached tieback hanger and other attachments. Because of the fixed orientation of key 342 relative to the tieback hanger face and the fixed orientation of the key's slot relative to the casing window, the tieback hanger will be advanced through the casing and the window in proper position for latching the flanges onto the window edge. The liner can then be manipulated using the hydraulic liner running tool.

It will be appreciated therefore that this tool is particularly useful in placement of a tieback hanger. The liner remains stationary only long enough for the tool to be rotated to located key 342 in its slot. This is a great reduction in liner stationary time over previous tools and prevents liner lock up against negative pressure formations.

The tools for formation and completion of deviated wells, as described hereinbefore and other not specifically described herein, require manipulation by rotation of the tool. In deep well operation and particularly in horizontal well applications, it is virtually impossible to rotate the tool by manipulation from surface.

Figure 15:
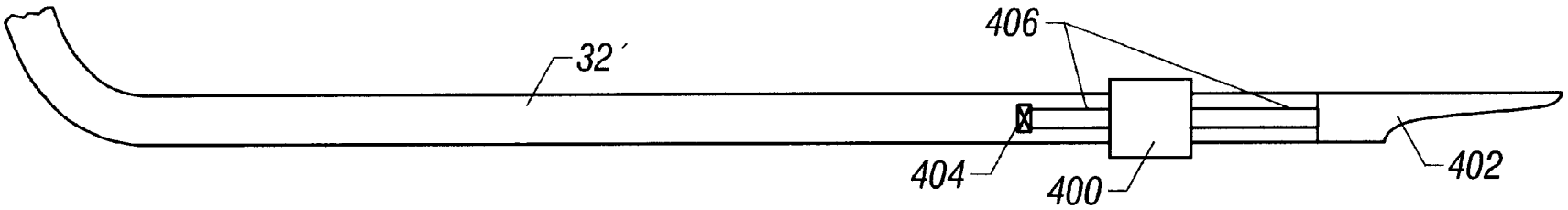
FIG. 15 is schematic representation of a system for imparting rotational force on a drill pipe.

Referring to FIG. 15, according to one aspect of the present invention, a motor 400 for imparting rotational drive such as, for example, a mud motor is connected at an end of a drill pipe 32' adjacent the tool 402 or well component to be rotated. The motor is connected to the drill pipe such that when the motor is driven, rotational force will be communicated to the drill pipe to cause it to rotate within the casing.

Preferably, the motor is driven by pumping drilling fluid therethrough. The motor is preferably a high torque, low speed motor which is selected to stall when the load thereon exceeds a selected level. In particular, when, for example, a tool is to be rotated until a latch drops into a slot, the motor will have a selected power to drive the drill pipe to rotate but when the latch is positioned in the slot and the load increases, the motor will stall to cease rotation of the drill string.

In an embodiment, where hydraulic pressure is required below the motor, such as for example, where the tool 402 is like tool 270 of FIG. 13, a bypass valve 404 is positioned above motor 400 to permit flow through a bypass port 406 passing without effect through motor and extending towards tool 402.

FIG. 11C shows a tieback hanger which is useful for tying back a liner having an outer diameter close to that of the casing inner diameter. FIGS. 17 to 19B show another tieback hanger 500 and casing 502 arrangement which is similarly useful but avoids increasing the OD or decreasing the ID of the casing at the window opening.

Figure 17:
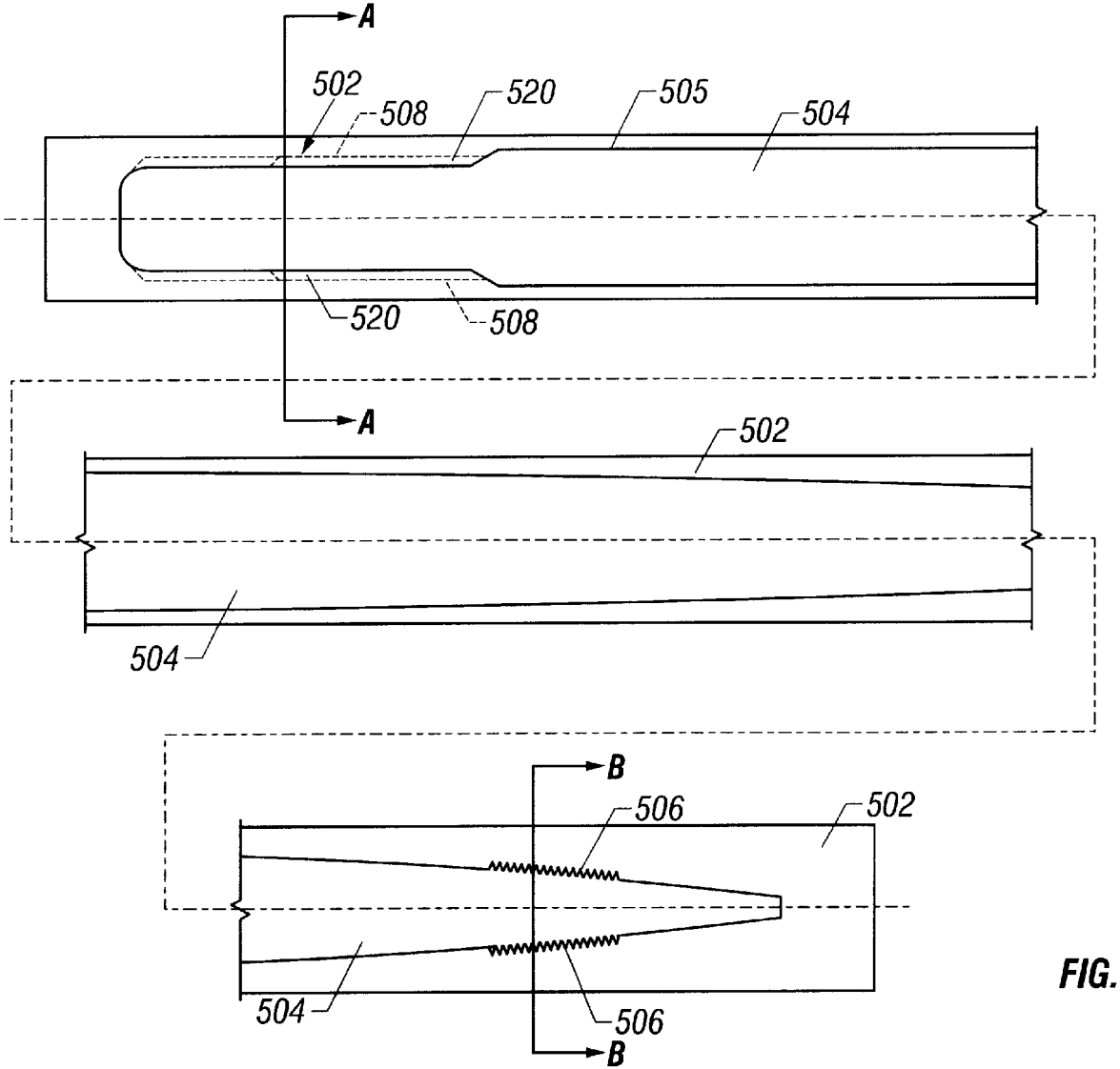
FIG. 17 is an elevation view of a casing section including a window opening according to the present invention.
Figure 17A:
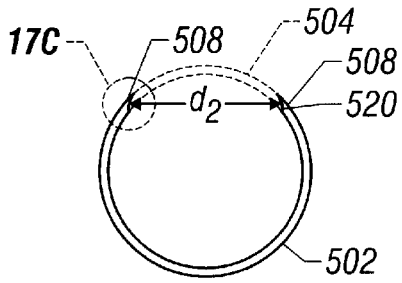
FIG. 17A is a sectional view along line A—A. of FIG. 17.
Figure 17B:
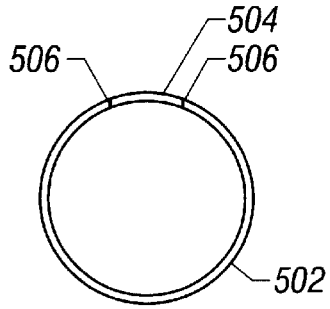
FIG. 17B is a sectional view along line B—B of FIG. 17.

Tieback hanger 500 is intended to be used with a casing 502, such as that shown in FIGS. 17 to 17B, having an window opening 504 formed therethrough. The casing wall edges 505 defining the window opening include profiled areas 506, 508 formed from the thickness of the casing wall material which extend inwardly over the window opening. Preferably, the profiled areas are formed to extend from the outer surface of the casing and to substantially follow the circumferential curvature of the casing outer wall. Preferably, the profiled areas are formed to taper gradually toward their edges so that a beveled edge is formed. The profiled areas can be formed to extend at selected positions around the window opening or about the entirety thereof. In the illustrated embodiment, profiled areas 506 are formed adjacent the bottom of window opening 504 and profiled areas 508 are formed adjacent the upper end of the window opening.

Figure 18:
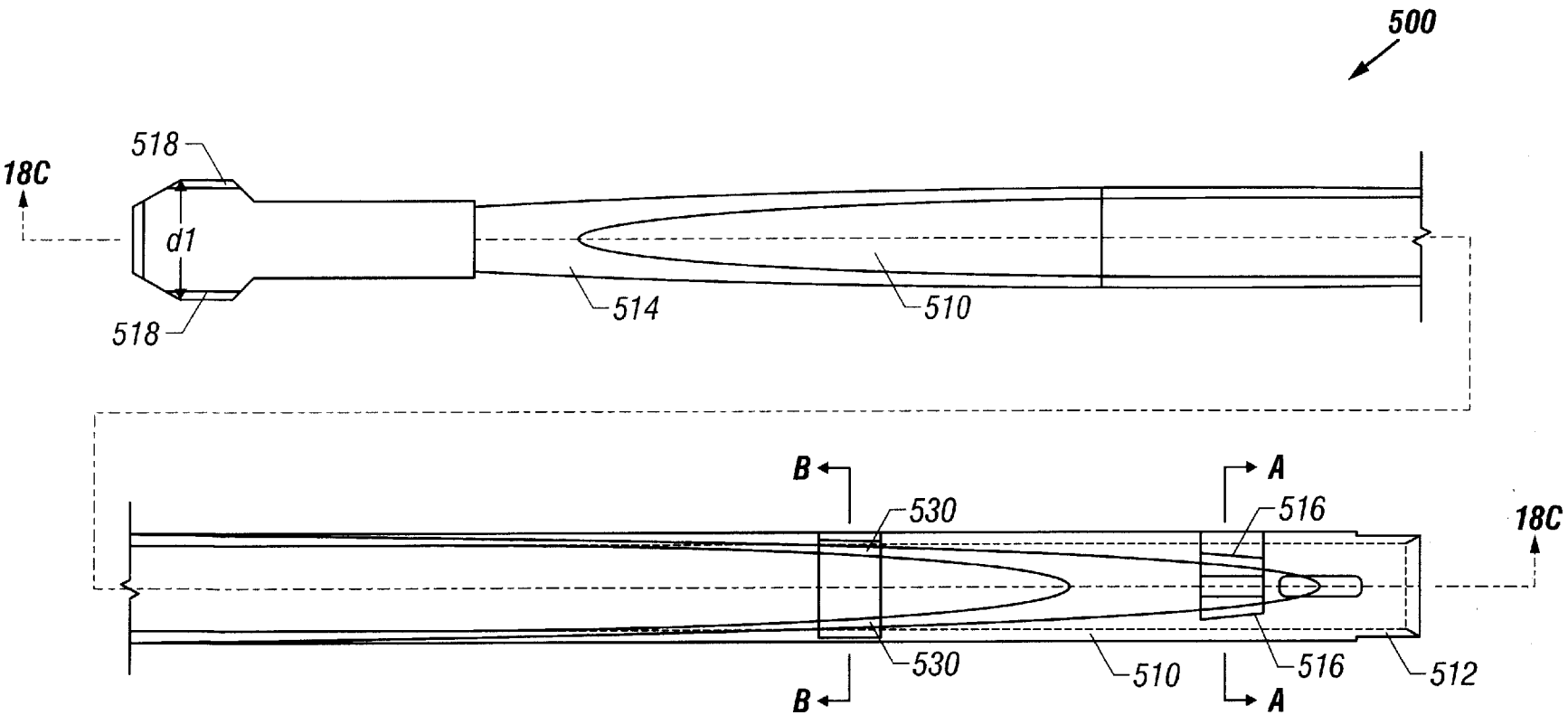
FIG. 18 is a front eievation view of a tieback Danger in accordance with another aspect of th present invention.
Figures 18A, 18B, 18C:
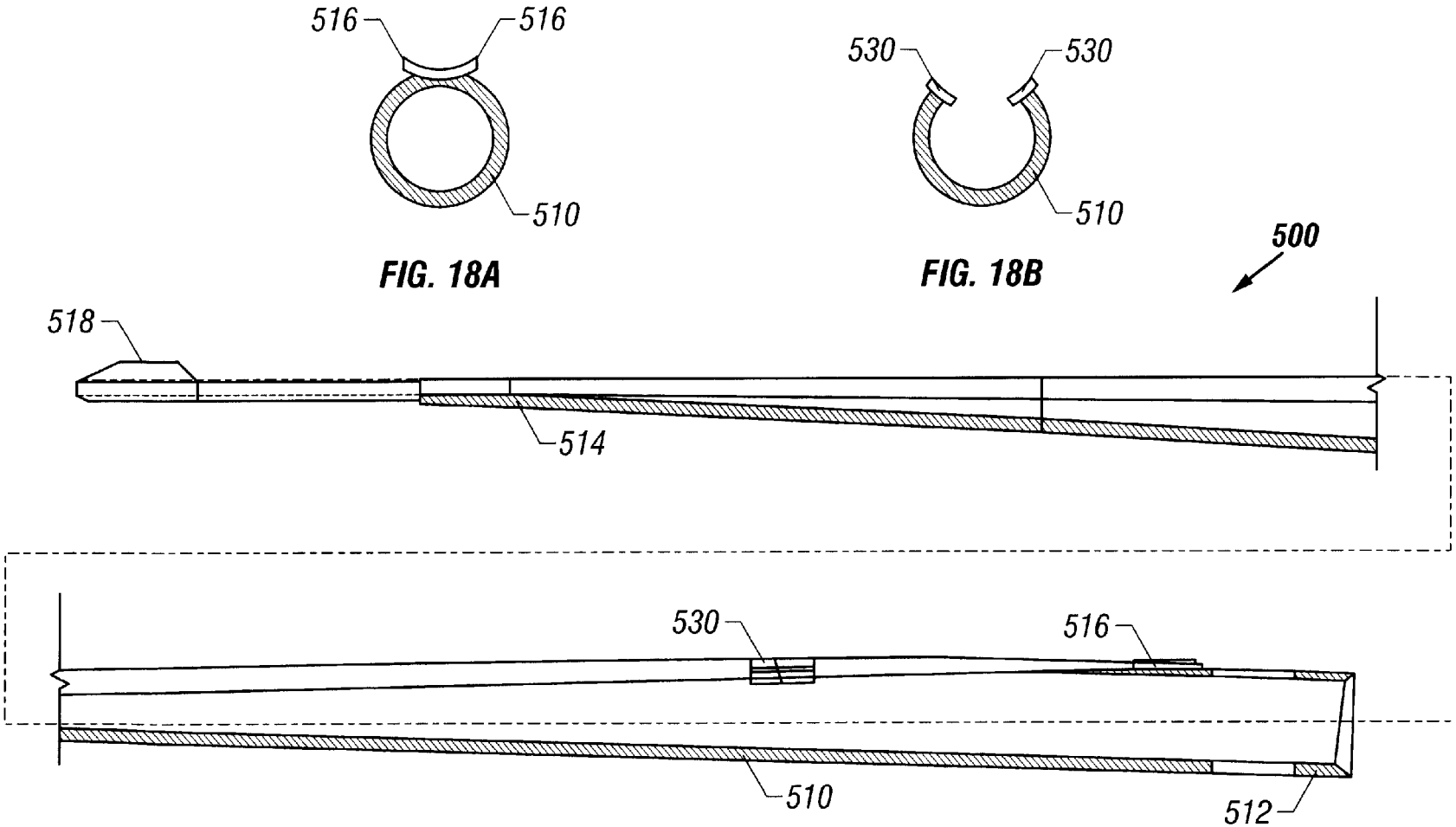
FIG. 18A is a sectional view along line A—A of FIG. 18 showing the lower setting tab.
FIG. 18B is a sectional view along line B—B of FIG. 18 showing the mid setting flanges.
FIG. 18C is a sectional view along line C—C of FIG. 18 showing the upper setting tab.
Figure 19A:
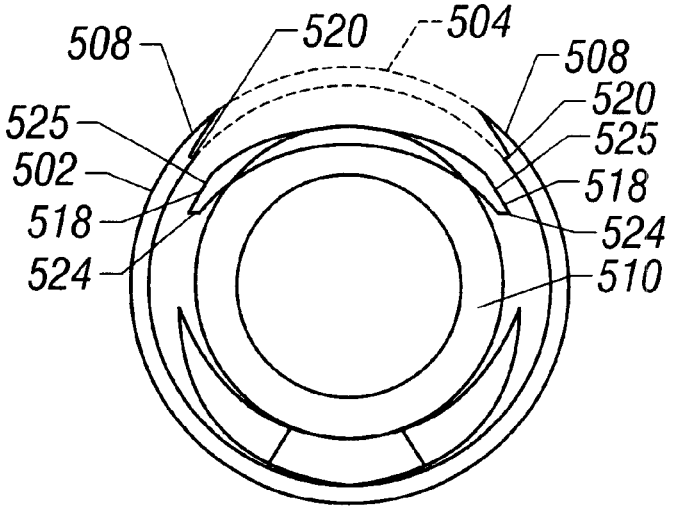
FIG. 19A is a sectional view through a casing section according to FIG. 17 having a tieback hanger according to FIG. 18 therein with the upper setting tab in unengaged position.
Figure 19B:
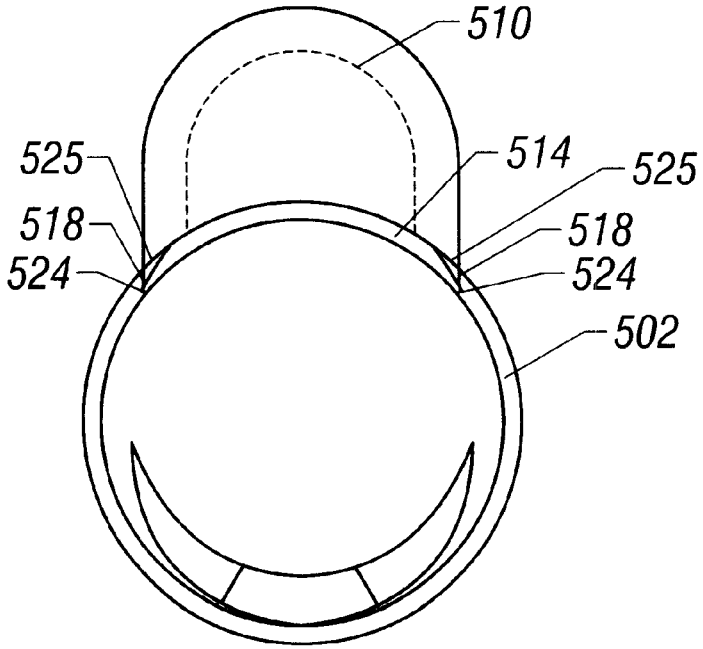
FIG. 19B is a sectional view as in FIG. 19A with the upper setting tab in engaged position in the window of the casing section.

Tieback hanger 500 includes a sleeve 510 including an outboard end 512 for connection to a lateral liner (not shown) and an anchored end 514 for connection to casing. End 514 has a lower setting tab 516 and an upper setting tab 518 formed to engage against the profiled areas 506, 508 formed about window opening 504. Setting tabs 516, 518 are formed to flare outwardly adjacent the edge of end 514 and to mate with the profiled areas 506, 508. Setting tab 516 forms a tapering dovetail configuration, as best seen in FIGS. 18 and 18A, which can be wedged between profiled areas 506 which form a tapering dovetail mortise, as best seen in FIGS. 17 and 17A. This prevents the tie back from being pushed entirely out of the window during setting. Upper setting tab 518 is also flared to form a dovetail, as best seen in FIG. 19A, which can be wedged against profiled areas 508. The thickness of setting tabs 516, 518 is preferably selected such that the end 514 substantially abuts against the outer surface of the casing, while the setting tabs substantially do not extend inwardly beyond the inner surface of the casing. This selected thickness provides that a minimum amount of material is added to the OD of the liner tieback.

When setting tabs 516, 518 are engaged against corresponding profiled areas 506, 508, tieback hanger will extend through the window opening and hang off from the casing.

Figure 17C:
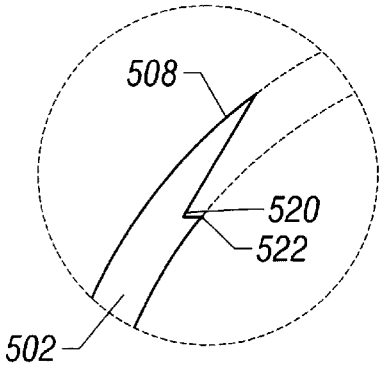
FIG. 17C is an enlarged view of an edge of the window opening, as noted in FIG. 17A.

In some wells, the laterals extend from the main well bore in such a way that the liner tieback can drop back into the casing and obstruct the passage of tools through the main well bore and into the lateral. In one embodiment as shown, the tieback hanger can be prevented from dropping into the casing by forming the edges of the window opening to engage the end of the tieback hanger against both passing through the window opening both outwardly and inwardly into the casing bore. The edges of the window opening can be formed so that the edges of the tieback hanger can snap into the opening and be engaged therein. In particular, as best shown in FIG. 17C, the window edges on which profiled areas 508 are formed include a recess 520 formed in the thickness of the casing wall. Recess 520 is formed between profiled area 508 and inner edge 522 of the window opening. Setting tab 518 is formed to wedge against profiled area 508 and engage into recess 520. Setting tab 513 includes an extension 524 (see FIGS. 19A and 19B) which can be snapped past edge 522 and be accommodated in recess 520. The recesses and extensions can be any suitable shape, provided that each extension can fit into its corresponding recess. Preferably, trailing edges 525 (see FIGS. 19A and 19B) of extensions 524 are chamfered to facilitate unsnapping of the tieback liner from the recess, if desired. Recesses and extensions can be elongate extending along selected lengths of the edges of the window. However, the positioning of the recesses and extensions on their respective parts must be selected so that they can be aligned and mated into each other.

In one embodiment, the distance d1 across the setting tab 518 is slightly greater than the distance d2 across the window between the profiled areas 508. This increases the engagement of the tieback hanger in the window opening and strengthens the casing about the window by transmission of forces.

Preferably, all profiled areas 506, 508 and recesses are formed in the wall thickness of the casing without changing the ID or the OD of the casing at the window.

In addition to the recess/extension engagement or as an alternative thereto, flanges 530 can be provided on the tieback hanger to abut against the edges of the window opening when the setting tab 516 are wedged between profiled areas 506. Flanges 530 acts to abut against the casing to prevent the tieback hanger from tipping back into the casing bore. It is useful to provide both the profiled area 530 and the recesses 520 to act as back up systems against each other.

Preferably all parts of the tieback hanger either sit within the window opening or extend outwardly of the window opening without extending into the bore of the casing, so that a sleeve, such as sleeve 123 of FIGS. 7A to 7C, can be rotated over the window opening 504.

It will be apparent that many other changes may be made to the illustrative embodiments, while falling within the scope of the invention and it is intended that all such changes be covered by the claims appended hereto.

The embodiments of the invention in which an exclusive property privilege is claimed are defined as follows:

1. A tool for running and retrieving a whipstock in a subterranean wellbore, comprising:

a tool body having one end adapted to be connected to a pipe, the tool body including a rail defined thereon adapted to selectively engage a slot defined on the whipstock and the pipe in fluid communication with a bore defined in the tool body; and the tool body including a latch assembly for releasably connecting to the whipstock;

wherein the latch assembly is adapted to be moved when pressure is applied to the tool bore through the pipe thereby enabling the connection and disconnection of the latch assembly from the whipstock.

2. The tool of claim 1, wherein the latch assembly comprises:

a latch that is biased outwardly from the tool body; and the latch adapted to be releaseably connected to a first slot defined on the whipstock.

3. The tool of claim 2, further comprising:

a piston assembly slidably disposed in the tool body bore and having a first end and a second end;

the piston assembly first end in fluid communication with the pipe; and the piston assembly second end slidably engaged to the latch;

wherein pressure applied through the pipe causes sliding movement of the piston assembly which causes radial movement of the latch thereby enabling the connection and disconnection of the latch from the whipstock first slot.

4. The tool of claim 3, wherein:

the piston assembly second end is tapered and rides on a ramped surface defined on the latch;

wherein increased pressure applied through the pipe causes the downward sliding movement of the piston assembly which causes the inward radial movement of the latch thereby enabling the connection and disconnection of the latch from the whipstock first slot.

5. The tool of claim 4, wherein the piston assembly is biased in the upward direction by a spring.

6. The tool of claim 2, wherein the latch is connected to the first slot at the same time the rail is engaged to a second slot defined on the whipstock.

7. The tool of claim 6, wherein the concurrent engagement of the latch to the first slot and the rail to the second slot enables the transfer of upward, downward, and rotational forces between the tool body and the whipstock without the risk of prematurely releasing the whipstock.

8. The tool of claim 2, wherein the latch is longitudinally aligned with the rail.

9. The tool of claim 2, wherein the rail is adapted to engage and disengage from a second slot defined on the whipstock by longitudinal movement of the tool body.

10. The tool of claim 9, wherein the rail is adapted to engage and disengage from the second slot when the latch is disconnected from the first slot.

11. The tool of claim 2, further comprising:

a first fluid delivery port extending between the tool body bore and the rail; and a second fluid delivery port extending between the tool body and a position adjacent the latch;

wherein pressurized fluid is passed through the first and second fluid delivery port when pressure is applied to the tool bore through the pipe thereby cleaning out the first slot and a second slot defined on the whipstock prior to engagement of the tool to the whipstock.

12. The tool of claim 2, wherein the tool body includes an orienting key biased outwardly from the tool body, the orienting key adapted to engage a casing slot defined in a casing section located in the wellbore.

13. The tool of claim 12, wherein a sloping face of the whipstock faces a window opening in the casing section when the orienting key engages the casing slot.

14. The tool of claim 12, wherein the rail is aligned with a second slot defined on the whipstock when the orienting key is engaged to the casing slot.

15. The tool of claim 2, wherein:

the tool body includes another key located substantially 180 degrees from the rail; and the another key is adapted to be biased outwardly when pressure is increased in the tool bore through the pipe;

so that the another key pushes against a casing section located in the wellbore thereby bringing the rail and a second slot defined on the whipstock into alignment prior to their connection.

16. The tool of claim 15, wherein the wellbore is a horizontal wellbore and the outward bias of the another key raises the tool body thereby bringing the rail and the second slot into alignment prior to their connection.

17. A method for running and retrieving a whipstock in a subterranean wellbore, comprising:

attaching a tool to the whipstock prior to deployment;

attaching a pipe to the tool, the pipe in fluid communication with the tool;

running the whipstock and the tool into the wellbore;

locating the whipstock at the proper location in the wellbore;

disengaging the tool from the whipstock by applying pressure through the pipe;

engaging a rail defined on the tool to a second slot defined on the whipstock; and engaging a latch located on the tool to a first slot defined on the whipstock.

18. The method of claim 17, wherein the rail engagement step comprises longitudinal movement of the tool body in relation to the whipstock.

19. The method of claim 17, wherein the latch engagement step comprises biasing the latch outwardly from the tool into the first slot.

20. The method of claim 17, wherein the running step comprises transmitting upward, downward, and rotational forces from the tool to the whipstock without prematurely releasing the whipstock.

21. The method of claim 17, wherein the locating step comprises orienting the whipstock so that a sloping face of the whipstock faces a window opening in a casing section in the wellbore.

22. The method of claim 17, wherein the disengaging step comprises:

disengaging a latch located on the tool from a first slot defined on the whipstock; and disengaging a rail defined on the tool from a second slot defined on the whipstock.

23. The method of claim 22, wherein the latch disengagement step comprises biasing the latch inwardly and away from the first slot.

24. The method of claim 23, wherein the inward bias of the latch is induced by the pressure applied through the pipe.

25. The method of claim 22, wherein the rail disengagement step comprises longitudinal movement of the tool in relation to the whipstock.

26. The method of claim 17, further comprising:

reengaging the tool to the whipstock by applying pressure through the pipe; and retrieving the whipstock and tool from the wellbore.

27. The method of claim 26, wherein the reengaging step comprises:

engaging a rail defined on the tool to a second slot defined on the whipstock; and engaging a latch located on the tool to a first slot defined on the whipstock.

28. The method of claim 27, further comprising prior to the rail engagement step applying pressure through the pipe to inwardly bias the latch within the tool.

29. The method of claim 28, wherein the latch engagement step comprises releasing the pressure through the pipe thereby enabling the outward bias of the latch.

30. The method of claim 28, wherein the rail engagement step comprises aligning the rail with the second slot of the whipstock.

31. The method of claim 30, wherein the alignment step comprises outwardly biasing another key from the tool based on the pressure applied through the pipe so that the another key pushes against a casing section located in the wellbore thereby bringing the rail and the second slot into alignment prior to their engagement.

32. The method of claim 31, wherein the wellbore is a horizontal wellbore.

33. The method of claim 27, wherein the rail engagement step comprises longitudinal movement of the tool in relation to the whipstock.

34. A tool for running and retrieving a downhole tool in a subterranean wellbore, comprising:

a retractable latch biased radially outwardly from the tool formed to fit within a slot formed on a downhole tool; and a rail formed to be insertable into a guide slot on the downhole tool and positioned to guide the latch into engagement in the slot.

35. The tool of claim 34, wherein the rail and the guide slot are correspondingly shaped.

36. The tool of claim 34, wherein the downhole tool comprises a whipstock.

* * * * *